US007805898B1

(12) United States Patent
Everitt

(10) Patent No.: US 7,805,898 B1
(45) Date of Patent: Oct. 5, 2010

(54) DO-IT-YOURSELF GLASS DOOR OR WINDOW HURRICANE PANEL LOWER EDGE SUPPORT AND ATTACHMENT SYSTEM

(76) Inventor: Thomas Joseph Everitt, 4320 Oak St., Little River, SC (US) 29566-8703

( * ) Notice: Subject to any disclaimer, the term of this patent is extended or adjusted under 35 U.S.C. 154(b) by 0 days.

(21) Appl. No.: 12/510,766

(22) Filed: Jul. 28, 2009

Related U.S. Application Data

(60) Provisional application No. 61/083,991, filed on Jul. 28, 2008.

(51) Int. Cl.
*E06B 3/26* (2006.01)

(52) U.S. Cl. ..... 52/202; 52/203; 52/846; 49/50; 49/61; 49/62

(58) Field of Classification Search ..... 52/202, 52/203, 831, 836, 837, 846; 49/50, 57, 61, 49/62; 248/208, 236
See application file for complete search history.

(56) References Cited

U.S. PATENT DOCUMENTS

| | | | | | |
|---|---|---|---|---|---|
| 3,745,704 | A * | 7/1973 | Covington | 49/57 |
| 4,333,271 | A * | 6/1982 | DePaolo et al. | 49/464 |
| 4,454,691 | A * | 6/1984 | Mitchell | 52/202 |
| 5,345,716 | A * | 9/1994 | Caplan | 49/61 |
| 5,347,775 | A | 9/1994 | Santos | |
| 5,430,981 | A * | 7/1995 | Scott | 52/202 |
| 5,540,018 | A * | 7/1996 | Biggers | 52/202 |
| 5,603,190 | A * | 2/1997 | Sanford | 52/202 |
| 5,620,037 | A * | 4/1997 | Apostolo | 160/118 |
| 5,651,221 | A * | 7/1997 | Golen | 52/202 |
| 5,768,833 | A * | 6/1998 | Golen | 52/202 |
| 5,855,099 | A * | 1/1999 | Hoffman | 52/202 |
| 6,189,264 | B1 * | 2/2001 | DiVeroli | 49/57 |
| 6,209,263 | B1 * | 4/2001 | Poirier | 49/61 |
| 6,263,625 | B1 * | 7/2001 | LaPointe | 52/202 |
| 6,314,684 | B1 * | 11/2001 | Aviram | 52/11 |
| 6,363,670 | B1 * | 4/2002 | Dewitt | 52/202 |
| 6,393,777 | B1 * | 5/2002 | Renfrow | 52/202 |
| 6,708,457 | B1 * | 3/2004 | Ballough | 52/202 |
| 6,820,381 | B1 | 11/2004 | Ballough | |
| 6,978,579 | B1 | 12/2005 | Trinca | |
| D541,140 | S | 4/2007 | Allen | |
| 7,305,800 | B1 * | 12/2007 | Calfee | 52/203 |
| 2003/0159373 | A1 | 8/2003 | Lien | |
| 2007/0107328 | A1 | 5/2007 | Munch | |
| 2009/0107061 | A1 | 4/2009 | Guthrie | |

* cited by examiner

*Primary Examiner*—Brian E Glessner
*Assistant Examiner*—James J Buckle, Jr.

(57) ABSTRACT

A do-it-yourself non-permanent hurricane panel supporting and securing device designed to allow property owner selection and installation of a variety of readily available storm panel materials over glass doors and windows as a means of protection from hurricane winds and associated flying debris. The system provides a base plate device for supporting and securing the lower edge of plywood and other hurricane panel materials available following hurricane alerts or warnings. Readily available owner selected channels or tracks engage the upper edge of the panel materials. The system is designed to allow property owners of multi-level apartments and condominiums to install hurricane panels over glass doors and windows with provisions for the installer to complete the installation from inside the glass door or window being protected.

11 Claims, 15 Drawing Sheets

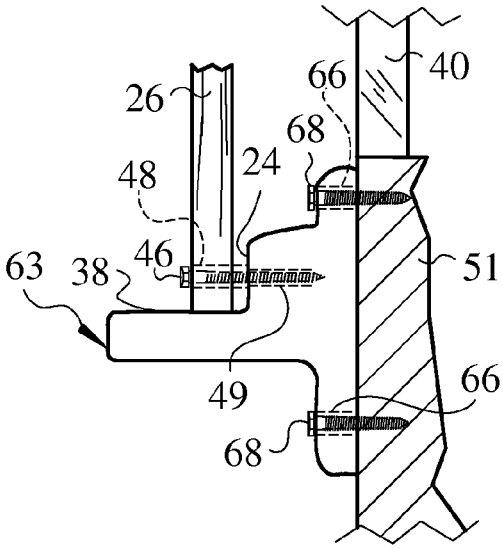
FIG. 11A
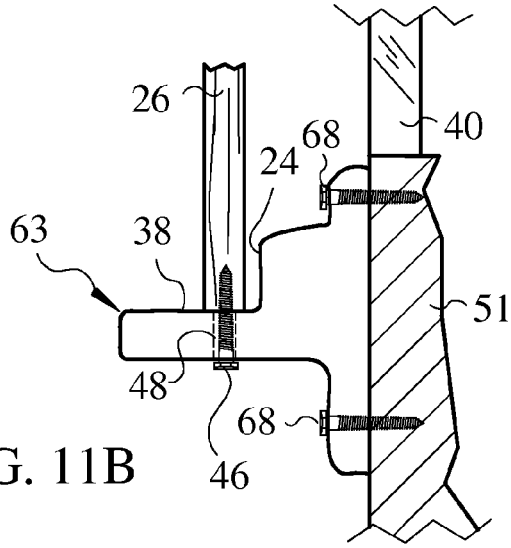
FIG. 11B
FIG. 11C
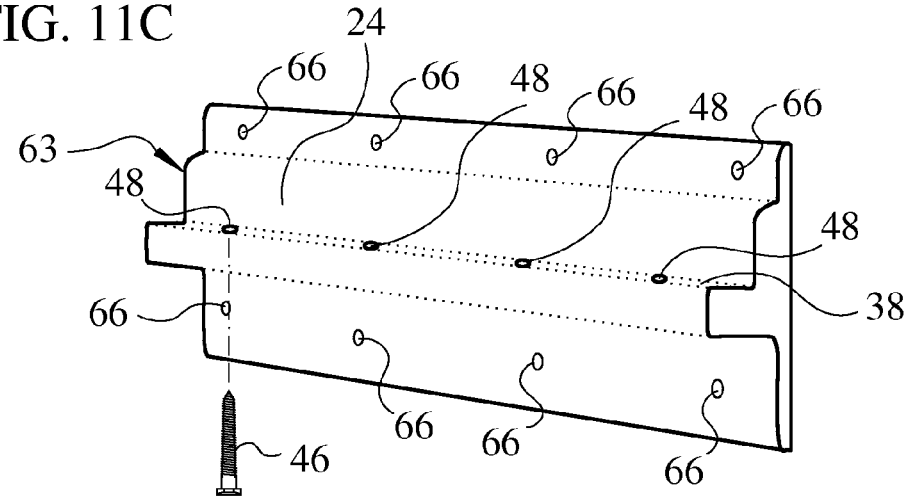

DO-IT-YOURSELF GLASS DOOR OR WINDOW HURRICANE PANEL LOWER EDGE SUPPORT AND ATTACHMENT SYSTEM

CROSS-REFERENCE TO RELATED APPLICATIONS

This application claims the benefit of provisional U.S. Patent Application Ser. No. 61/083,991, filed Jul. 28, 2008 by the present inventor. This application refers to panel attachment devices disclosed in utility U.S. patent application Ser. No. 11/966,626, filed on Dec. 28, 2007 by the present inventor.

FEDERALLY SPONSORED RESEARCH

Not Applicable

SEQUENCE LISTING

Not Applicable

BACKGROUND OF INVENTION

1. Field of Invention

This invention relates to devices for supporting, attaching and securing hurricane panels, specifically to a do-it-yourself glass door or window hurricane panel lower edge support and attachment system as a primary component in protection systems for home and business owners in that period following a hurricane watch or warning.

2. Prior Art

The 2005 Atlantic hurricane season began Jun. 1, 2005 and lasted until Nov. 30, 2005. Unexpectedly, this became a most active season, shattering records on repeated occasions, with 27 tropical storms formed, of which a record 15 became hurricanes. The impact of the 2005 season was widespread and ruinous with recorded damages of over $ 100 billion and a death toll approaching 2,000 lives.

The most common materials causing severe damage and breakage during severe storms include roof shingles, roof tiles, children's play ground toys, lawn furniture, tree limbs, outdoor grills, fencing materials, garbage cans, and a wide variety of similar airborne missiles. Studies of damage from recent hurricanes show that most of the damage to homes was from wind or wind-borne missiles that broke the windows and glass doors and let rain and wind into the home. Once the integrity of a structure has been broken, the resultant storm pressure may blow out other windows and lift roofs from the structures. This "Venturi Effect" is a special case of the Bernoulli Principle, or the reduction of pressure producing a partial vacuum.

Only a small percentage of the 40 million property owners along our total hurricane-prone coastline of 2,911 miles have currently installed hurricane protection over glass doors and windows. The Atlantic Coast of 1,280 miles extends from Virginia to Florida and the Gulf Coast of 1,631 miles extends from Florida to Texas.

The current state of storm protection prior art offers a number of window-related protection systems, many of which require complex manufacturing capabilities and professional installation skills. These effective systems are targeted for the upper middle class and above. Affordable and rapid do-it-yourself protection systems are needed to assist property owners in the short time period following a hurricane watch or warning.

Hurricane protection of windows is the primary focus of the large and expanding number of sophisticated, effective, and commercially available systems for home and business owners is hurricane protection of windows. Protection of sliding glass patio and French type doors and commercial glass entrance doors are areas of minimum attention, when compared to window protection systems. Protection of wide glass doors involves a number of more difficult and complex problems than the average window.

Property owners of upper level or high-rise properties, those above ground level, are unable to protect their glass doors from hurricane forces. Most of the limited systems designed specifically for glass doors require attachment of hurricane panels from outside the glass door to be protected, making it impossible for the installer to re-enter the structure following the installation. Prior art provides few glass door systems designed to allow an installer access back into the structure following installation of the hurricane panels over the glass door opening.

My previous patent application Ser. No. 11/966,626, filed on Dec. 28, 2007, provides a commercially successful, do-it-yourself solution for rapid attachment of plywood or plastic panels over windows. This system involves a lower and upper track and channel system requiring sliding the hurricane panel into position over the window. Full size sheets of ¾", ⅝" and ½" plywood necessary to protect wide expanses of glass are unwieldy, heavy and difficult for the average homeowner to lift into a track or slide down a channel into position over wide expanses of floor level glass.

U.S. Pat. No. 3,745,704 to Covington (1973) discloses aluminum extrusions shaped to receive and support a single removable plywood panel. The system requires the lifting of a panel into a U shaped track. Such track and channel systems are subject to collection of debris, leaves and other common airborne contaminants during periods when panels are not in place. The invention also describes installing the system on the inside of the window opening in multi-story buildings. The system would not protect the glass window from breakage when installed inside the building structure. The system installation skills required are beyond what can be expected of a do-it-yourself homeowner seeking rapid retrofit protection of wide window expanses following a hurricane watch or warning.

U.S. Design Pat. No. D541,140 to Allen (2007) illustrates a storm shutter track design to contain one (1) or more sliding tracks for storm shutters requiring the lifting of panels into place.

U.S. Pat. No. 5,347,775 to Santos (1994) provides for top and bottom rails mounted on a vertical building surface. No provision is provided for installation on a flat deck or horizontal surface. Manufacturing the system would require extensive tooling and set up costs. Installation is of such a nature as to be complex to a homeowner with moderate do-it-yourself skills and tools, in the short period of time prior to the arrival of a hurricane. No provisions are provided for the installation of a hurricane panel from inside the structure of the opening to be protected.

U.S. Pat. No. 6,820,381 to Ballough (2004) discloses a storm shutter attachment system designed to be attached to the exterior wall portion of a house or building. The stated objectives of the invention are to provide for non-visible mounting of the upper portion of a storm shutter. This invention was not designed to provide for a solution to support, attach and secure plywood hurricane panels to deck level patio door openings.

U.S. Pat. No. 6,978,579 to Trinca (2005) requires the use of the existing screen track of the window opening to be protected. Patio door screen tracks lack the design and structure to support the weight of full size sheets of ⅝" or ¾" plywood panels. French doors do not provide for screens. The present invention is compatible with French styled doors and commercial office doors. This referenced patent is not a deck-mounted system for do-it-yourself installation of storm panels.

U.S. Patent Application 2007/0107328 to Munch (2007) discloses a panel attachment system composed of upper track of an "h" shape and lower track of an "f" shape mounted to a vertical wall of the structure. Storm panels are inserted in an upper track and hinge down to exactly match apertures in the panel with extended threaded fasteners in the lower track system. No provision is provided to support, secure, and attach full size sheets of panel material to a flat horizontal deck or structure. The system is installed from outside the structure.

U.S. Patent Application 2003/0159373 to Lien (2003) discloses a protective board U channel hinged track system mounted on the top and bottom frame parts of the window. The invention is not designed for homeowner installation of a system to protect the oversize openings of patio doors installed flush with concrete, composite or wooden deck structures.

U.S. Patent Application 2009/0107061 to Guthrie (2009) discloses a structural reinforcement system to reinforce sliding glass door structures against storm force winds. Once installed, the system increases the structural integrity of the sliding glass door structure by increasing the ability of the door to withstand being blown inward or outward by storm force winds. This invention discloses no protection to the glass portion of the sliding glass door from flying debris associated with hurricane conditions.

U.S. Pat. No. 6,131,354 to Thompson (2000), discloses a complex system of locking mechanisms, brackets and mounts that are permanently attached to a structure. The bracketed system is not simple in nature and not suitable for installation during the hours prior to a storm making landfall.

The problems involved in protecting wide, deck level expanses of glass doors and windows has led the hurricane protection industry to concentrate on the more simple art of protecting ground level windows. Considering the number of windows in a home compared to the number of wide glass doors, this direction is understandable. Practical, affordable and rapidly installed do-it-yourself homeowner protection systems for patio type and French type doors with plywood or corrugated plastic panels are a neglected art.

Following a storm warning, the demand for plywood and other types of panels is heavy at building material suppliers and big box lumberyards. The missing component during this rush for protection is a fast and simple way to install temporary storm panels with minimum damage to the structure, damage associated with nailing and bolting the panels directly to the building structure. Sheets of plywood and other materials are heavy, unwieldy, and essentially impossible for one person to support and to hold a sheet in place while trying to nail it to the structure, especially if the weather is deteriorating.

The panel attachment systems for attaching protective storm panels over wide expanses of glass, heretofore known, suffer from one or more of the following disadvantages:

(a) Their basic design is for window protection applications of average size openings, unlike the larger sized openings of patio style sliding glass doors, French type doors, and wide commercial expanses of glass doors and windows.

(b) Their fabrication requires a manufacturer capable of complex mechanical sub-assemblies, extrusions, foundry or casting capabilities, and adherence to precise tolerances. Tooling costs prior to manufacturing are substantial.

(c) A majority of prior art devices are fabricated of metal. Coastal climates are known for corrosive salt air that will eventually cause aluminum to corrode, steel to rust, and plating to deteriorate. Stainless steel is an obvious but prohibitively expensive alternative metal material.

(d) "U" shaped channels and tracks with close tolerances are subject to the drawbacks of debris accumulation, rendering them less than optimum. Some prior art examples with close tolerances may also be rendered less than optimum due to the need for refinishing in corrosive salt air environments.

(e) A majority of available systems do not allow passage back into the structure following storm panel installation, making these systems unusable for above ground level installations.

Prior art does not provide the missing component in this protection scenario for a simple and low cost apparatus designed specifically for do-it-yourself home and business owners to attach full sheets of plywood or plastic over wide expanses of glass with relative ease. A system is needed to eliminate the need to lift the full weight of the panel and provide for attachment of panels to a deck or other horizontal surface using ordinary do-it-yourself tools in the short period following a hurricane watch or warning. Upper level protection is precluded by the majority of systems requiring installation from outside the opening without a provision for re-entering the structure.

3. Advantages

Accordingly, one or more embodiments of the present invention may have one or more of the following advantages:

(a) to provide a hurricane panel lower edge attachment device, which can be installed with average do-it-yourself tools and skills;

(b) to provide a hurricane panel lower edge attachment device, which can be installed by a property owner with only the hours remaining after a hurricane watch or warning;

(c) to provide a hurricane panel lower edge attachment device impervious to degradation, corrosion, oxidation or other common problems associated with coastal salt air environments;

(d) to provide a hurricane panel lower edge attachment device fabricated from relatively low-cost materials in plentiful supply to enhance affordability;

(e) to provide a hurricane panel lower edge attachment device designed to eliminate custom designing, professional installation, and extended lead times;

(f) to provide a hurricane panel lower edge attachment device of compatible components allowing for side by side installation for protecting long expanses of glass doors and windows;

(g) to provide a hurricane panel lower edge attachment device with provisions for access back into the structure being protected following the installation of panels;

Further advantages of this do-it-yourself horizontal base lower panel edge installing, attaching, and securing system for full sized sheets of plywood or plastic panel materials to protect extended expanses of glass doors or windows will become apparent from a consideration of the drawings and ensuing description.

SUMMARY

The embodiments of this do-it-yourself invention are directed towards an improved system for property owner installation of hurricane panels of a variety of available hurricane panel materials in front of glass doors and windows in the short period of time prior to the arrival of a hurricane. The device allows owners of multi-level properties to complete the hurricane panel protection process from the inside area of the glass door or window to be protected.

DRAWINGS

Figures

In the drawings, closely related figures have the same number but different alphabetic suffixes.

FIG. 11A shows a side view of an extruded vertical mounted panel unit attached to an exterior surface with panel attachment fasteners passing through the frontal surface of the hurricane panel depicted.

FIG. 11B shows a side view of an extruded vertical mounted panel unit attached to an exterior surface with the hurricane panel secured upon the panel supporting surface by panel attachment fasteners.

FIG. 11C shows a perspective view of an extruded vertical mounted panel unit.

DRAWINGS

Reference Numerals

Figure 1:
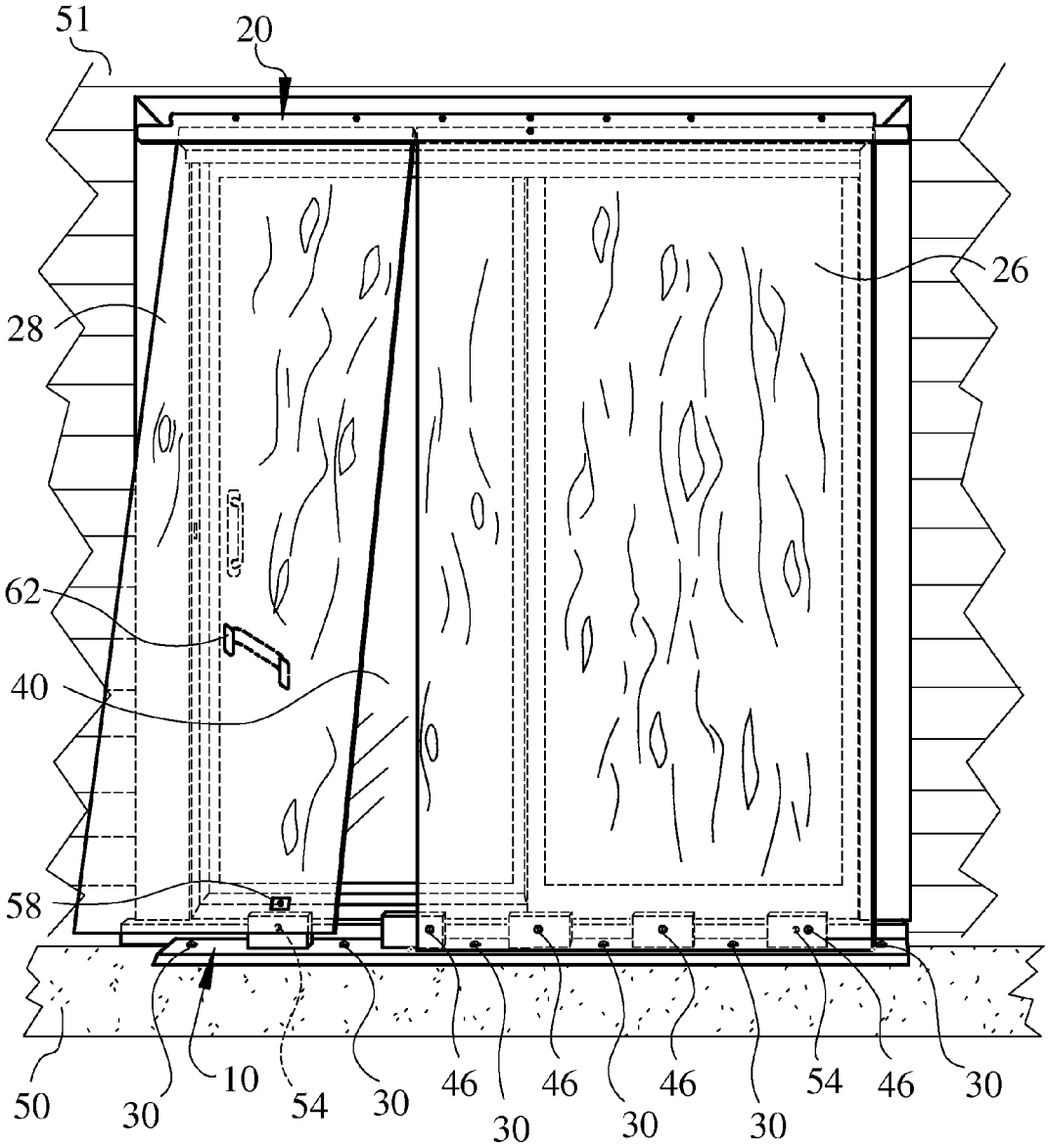
FIG. 1 shows a frontal perspective view of the device mounted on a deck with a stationary hurricane panel installed and an access hurricane panel partially installed.

10 panel base plate unit
12 base plate supporting element
14 standard attachment element
15 attachment element with aperture
16 bonded joint
20 upper panel track securing device
22 beveled panel "kick-up" surface
23 rear base plate edge
24 attachment surface
26 stationary hurricane panel
28 inside access hurricane panel
30 base plate attachment fastener
32 base plate unit attachment aperture
36 base plate bonding and attachment surface
37 bonding and drilling pencil line
38 panel supporting surface
40 glass unit to be protected
44 panel drill locator dimple
46 panel attachment fastener
48 panel fastener aperture
49 panel fastener pilot aperture
50 exterior horizontal surface
51 exterior vertical surface
52 interior horizontal surface
53 interior vertical surface
54 attachment element access aperture
56 access panel securing fastener
58 access panel cooperating receiving fastener
60 access panel receiving fastener aperture
62 interior handle
63 vertical mounted panel unit
64 vertical mounting element
66 vertical mounting aperture
68 vertical mounting fastener
80 sill base plate unit
82 slanted window sill surface

84 sill plate lip

DETAILED DESCRIPTION OF THE FIRST EMBODIMENT

Referring now to the drawings, one form of the do-it-yourself glass door or window hurricane panel lower edge support and attachment unit embodying the principles and concepts of the present invention will be described. One embodiment of the attachment unit is illustrated in FIG. 1, (frontal perspective view) and FIG. 2E (perspective view) of an installed system with one (1) stationary hurricane panel 26, one (1) inside access hurricane panel 28, and an upper panel track system 20. As can be seen by reference to the drawings, and in particular to FIG. 2E, the panel base plate unit 10 forms the basis of this embodiment. Referring to FIG. 2E, the material of choice for this embodiment is free-foam cellular PVC trim board. This material will be the material of choice for the base plate supporting element 12 (FIG. 2C), the standard attachment elements 14 (FIG. 2A) and the attachment elements with apertures 15 (FIG. 2B).

This free-foam cellular PVC trim material is selected for a number of reasons including an extruded material totally impervious to insects, moisture, and salt air damage. It can be cut and drilled using the same tools used to cut lumber. The recommended water-based, non-toxic, odorless, UV stable PVC adhesives provide a strong bond, creating a joint as strong as the material itself. The material does not require painting but readily accepts acrylic latex finishes of different colors. Building supply centers offer the trim board under a number of trademarked names including Azek®, Koma®, Versatex®, Plasticlad®, and a number of other trade names, most with lifetime warranties. However, the board material can be of other outdoor treated or untreated lumber or PVC extrusions. A common, usable, and recommended PVC trim board size is ⅝"×3½" in various lengths up to 20' (feet).

The method of fabrication of this embodiment is as follows. The base plate supporting element 12 is cut to a predetermined length, depending upon the width of the glass unit to be protected 40. Standard sliding glass patio doors and French type doors are sold in six (6) foot and five (5) foot standard widths. For this embodiment fabrication example, the most popular six (6) foot, (72 inch) width will be selected. It is obvious that the panel base plate unit 10 could be fabricated in virtually an unlimited number of lengths, dependent upon the width of the glass expanse to be protected. Regardless of the length of the fabrication of the panel base plate unit 10, the design of the system allows for side-by-side, end-to-end installation of multiple panel base plate units 10 for protecting wide expanses of glass doors and windows.

Figure 3A:
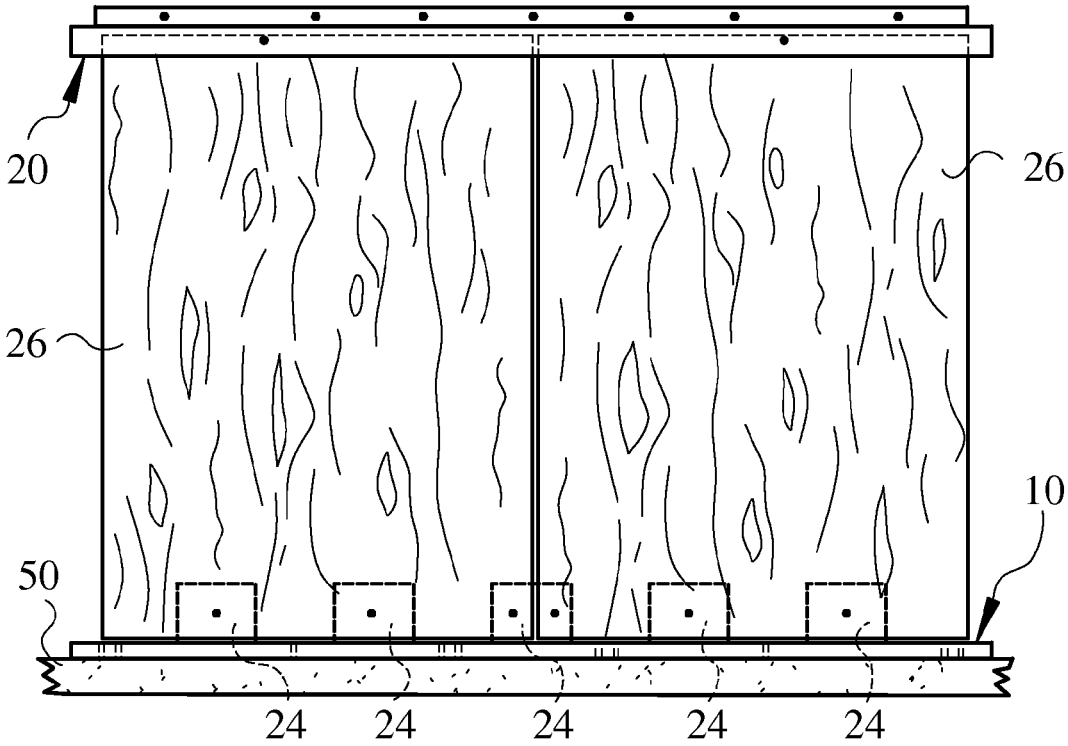
FIG. 3A shows a frontal view of an installed panel base plate unit with stationary hurricane panels installed.
Figure 3B:
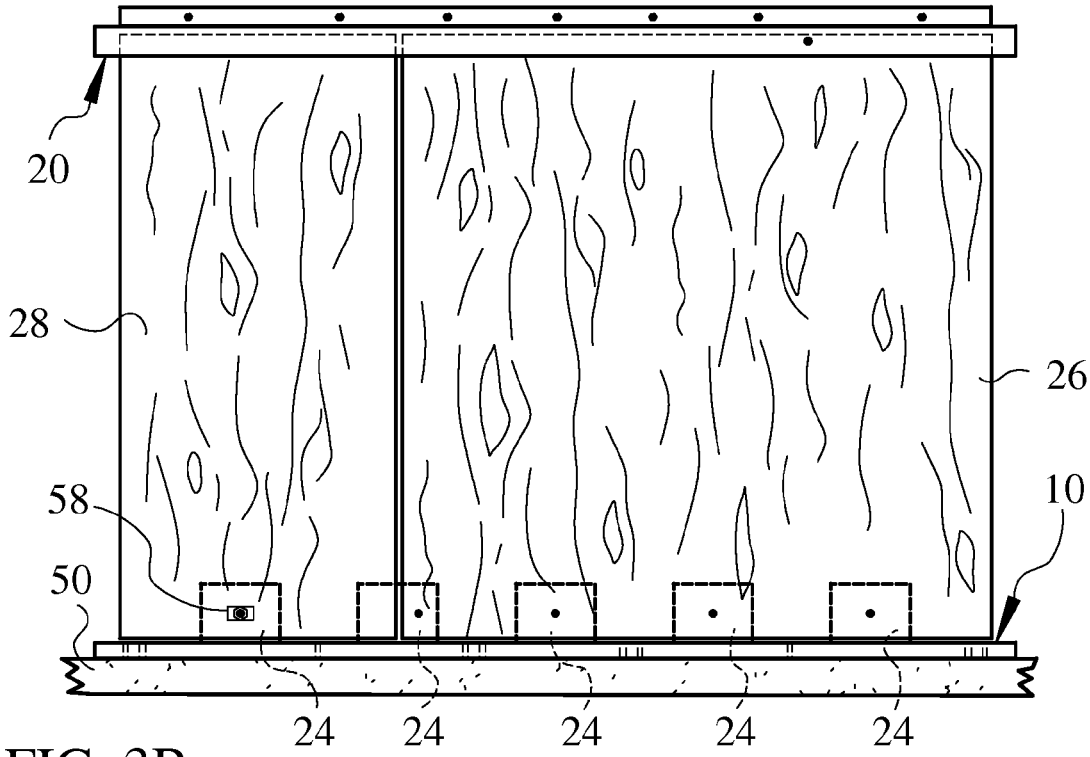
FIG. 3B shows a frontal view of an installed panel base plate unit with a stationary hurricane panel and an inside access hurricane panel installed.

The width and length of standard plywood sheathing is four (4) feet wide by eight (8) feet long. This example fabrication of the panel base plate unit 10 has been determined to be a standard and popular six (6) feet in width, thus the example will require more than one (1) sheet of plywood to complete and illustrate the installation. The fabrication of the six (6) foot panel base plate unit 10 will require three (3) standard attachment elements 14 and two (2) attachment elements with aperture 15. FIG. 3A illustrates the option of securing two (2) stationary hurricane panels 26. FIG. 3B illustrates the option of securing one (1) stationary hurricane panel 26 and one (1) inside access hurricane panel 28.

The fabrication method of this standard size six (6) foot panel base plate unit 10, as illustrated in FIG. 2E, will include provisions for accepting a combination of two (2) stationary hurricane panels 26 (FIG. 3A) for ground level installations or a combination of one (1) stationary hurricane panel 26 and one (1) inside access hurricane panel 28 (FIG. 3B) for high rise or other multi-level, above ground level installations. Commercial success will be greatly enhanced by providing the current missing component of a system capable of protecting above ground level sliding glass patio door units to be protected 40, such units common to multi-level structures.

Figure 2A:
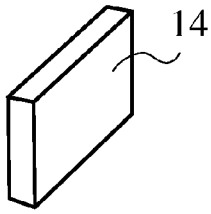
FIG. 2A shows a perspective view of a standard attachment element.
Figure 2B:
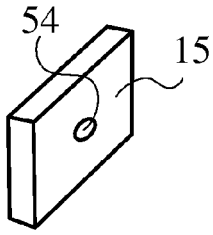
FIG. 2B shows a perspective view of an attachment element with aperture.

FIG. 2A illustrates a standard attachment element 14. FIG. 2B illustrates an attachment element with aperture 15. The material recommended for the base plate supporting element 12 is cellular PVC trim board. The preferred dimensions of the trim board are ⅝"×3½", available in a wide variety of lengths. This recommended trim board will be used to fabricate the base plate supporting element 12, the standard attachment element 14, and the attachment element with aperture 15. The attachment elements 14 and 15 will be sawed from trim board planks with a recommended length of six (6) inches for each element. A trim board plank will be sawed a length of six feet (72 inches) to produce a base plate supporting element 12. The fabrication of the six (6) foot long panel base plate unit 10 will require three (3) standard attachment elements 14 and two (2) attachment elements with aperture 15 for a total of five (5) attachment elements.

Following the sawing operations described, the fabrication of the two (2) attachment elements with aperture 15 will require drilling the attachment element access aperture 54 in the center of the of the attachment elements with aperture 15 as illustrated in FIG. 2B. The recommended drill size for the attachment element access aperture 54 is ½" diameter.

Figure 2C:
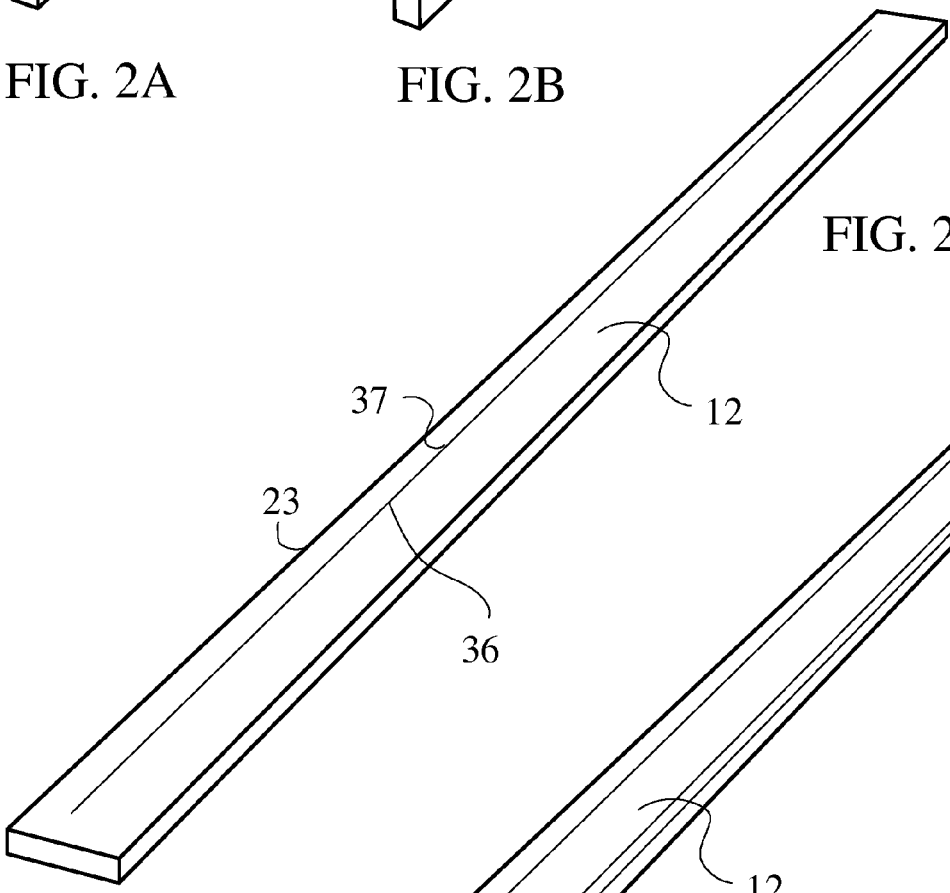
FIG. 2C shows a perspective view of a base plate supporting element.

FIG. 2C is a perspective view of the base plate supporting element 12 prior to the beveling, bonding, and drilling processes to be described next.

Figure 2D:
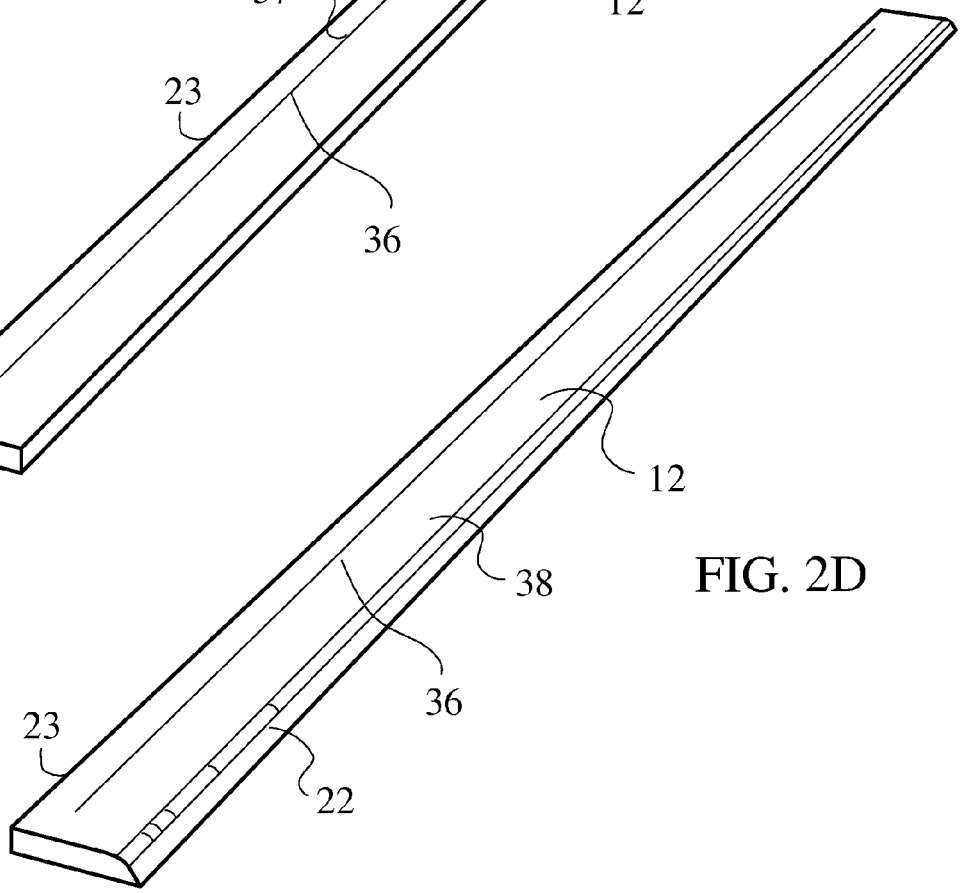
FIG. 2D shows a perspective view of a base plate supporting element with a beveled panel "kick-up" surface.
Figure 2E:
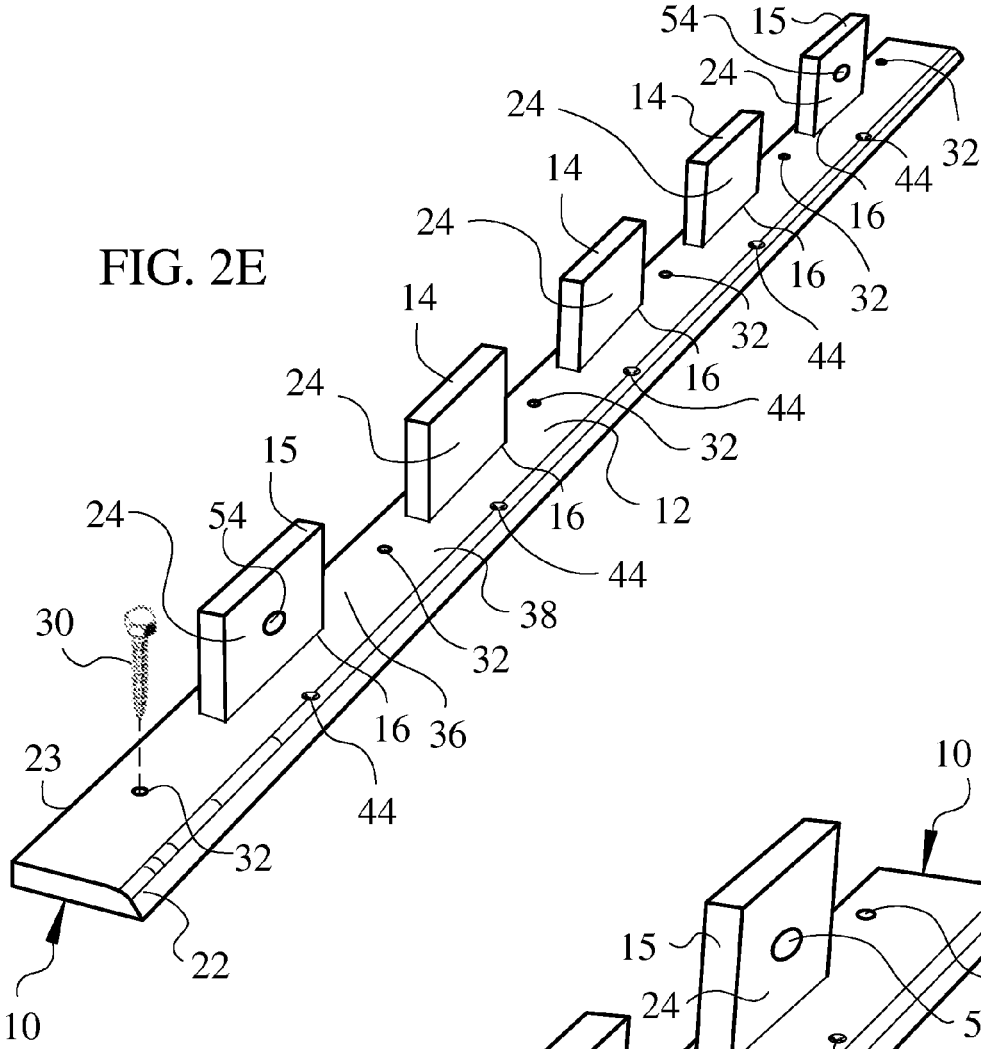
FIG. 2E shows a perspective view of a fabricated panel base plate unit.

Referring now to FIG. 2D, the beveled panel "kick-up" surface 22 along the edge of the base plate supporting element 12 is formed by sawing or routing a beveled or chamfered surface of approximately 45° along one edge of the base plate supporting element 12 as illustrated in FIG. 2D. Following the sawing or routing procedures it is recommended that the beveled panel "kick-up" surface 22 be sanded with a fine grade sandpaper to remove all rough edges. Such sawing, routing, and sanding procedures would be readily carried out by a person of ordinary skill in the art.

In order to proceed with the bonding and drilling requirements, it is recommended that a light bonding and drilling pencil line 37 be scribed 1⅛" from the rear base plate edge 23 along the base plate bonding and attachment surface 36. This bonding and drilling pencil line 37 will provide a centerline for the bonding of the standard attachment elements 14 and the attachment elements with aperture 15 to the base plate bonding and attachment surface 36. As illustrated in FIG. 2E, once bonded, the parallel elements 12 and 14 provide the necessary attachment faces 24 for attaching and securing stationary hurricane panels 26 or an inside access hurricane panel 28.

Referring now to FIG. 2E, the bonding of the standard attachment elements 14 and the attachment elements with aperture 15 to the base plate bonding and attachment surface 36 of the base plate supporting element 12 will be described. PVC materials have characteristics permitting the fusion of materials together upon the application of commercially available PVC liquid fusion compounds. The major suppliers of the free foam cellular PVC trim board recommended in this embodiment provide adhesives to maximize the bonding of these materials to each other. These adhesives are water-based PVC cements that are non-toxic, odorless, UV stable, and easily cleaned up with water. The adhesives are available in 4 ounce to 5 gallon containers. A proven and readily available PVC cement is Azek® adhesive. Such adhesives are readily selectable by a person of ordinary skill in the art.

The bonding process will begin with the bonding of the middle or center located standard attachment element 14 (FIG. 2E) bonded equidistant from each end of the base plate supporting element 12 and centered along the bonding and drilling pencil line 37 described earlier in the process, creating a bonded joint 16. Next, the attachment elements with apertures 15 will be positioned at opposite ends of the base plate supporting element 12 as illustrated in FIG. 2E and should be bonded with the center of the attachment elements with aperture 15 approximately 11 inches from the closest end of the base plate supporting element 12 and centered along the bonding and drilling pencil line 37, creating a bonded joint 16.

FIG. 3B illustrates the utility and need for careful placement of the two (2) remaining un-bonded standard attachment elements 14 in providing the necessary position for attachment and securing of a combination of a stationary hurricane panel 26 and an inside access hurricane panel 28. Referring now to FIG. 2E, the two (2) remaining and unbonded standard attachment elements 14 will be bonded and centered along the bonding and drilling pencil line 37 with the mid-point or center of each of the two (2) remaining standard attachment elements 14 centered a recommended twenty four (24) inches from the closest end of the base plate supporting element 12 (FIG. 2E).

The drilling of the base plate unit attaching apertures 32 will be described. A recommended drill size of ⅜" for the base plate unit attachment aperture 32 will provide clearance for 5/16" or ⅜" base plate attachment fasteners 30. As illustrated in FIG. 2E, it is recommended that a plurality of base plate unit attachment apertures 32 be drilled on the base plate bonding and attachment surface 36 of the base plate supporting element 12 to provide base plate unit attachment apertures 32 centered on the bonding and drilling pencil line 37. One (1) base plate unit attachment aperture 32 should be located and drilled at each end of the base plate supporting element 12 (FIG. 2E) and one base plate unit attachment aperture 32 located and drilled equidistant between each of the standard attachment elements 14 and the attachment elements with apertures 15, located equidistant between each of the described attachment elements, as illustrated in FIG. 2E.

Figure 2F:
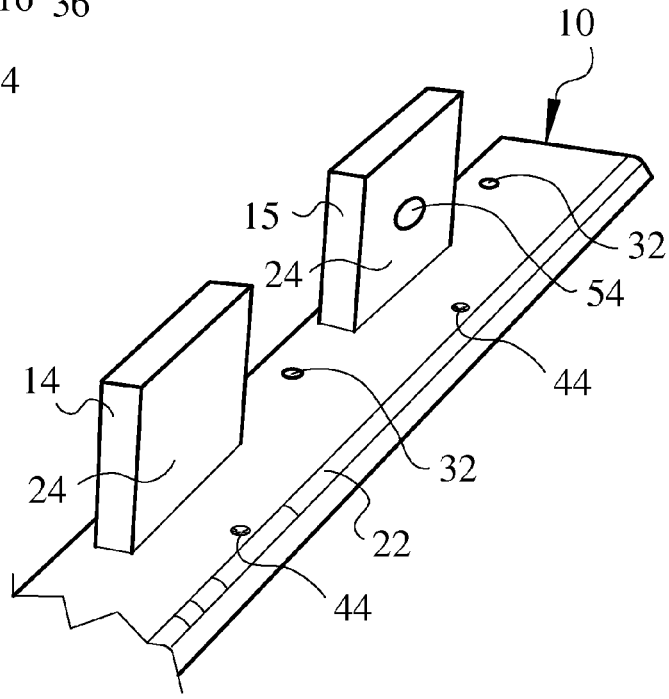
FIG. 2F shows a close-up partial perspective view of a fabricated panel base plate unit.
Figure 2G:
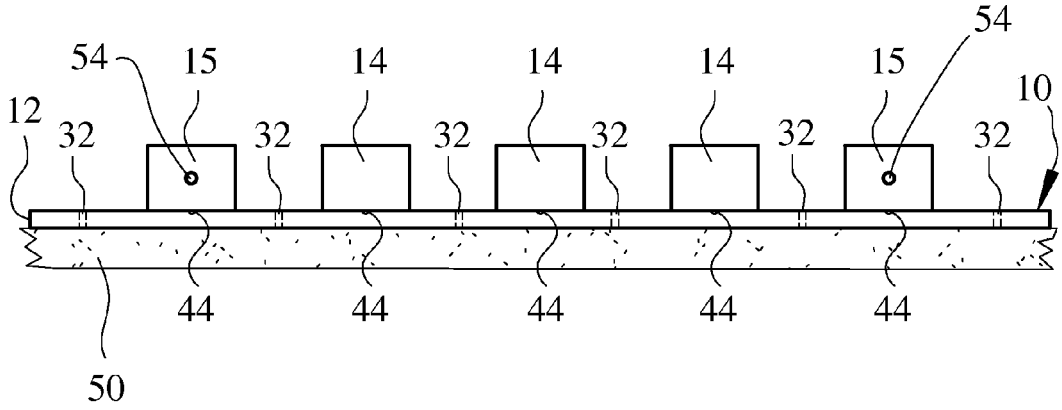
FIG. 2G shows a front view of a panel base plate unit.
Figure 2H:
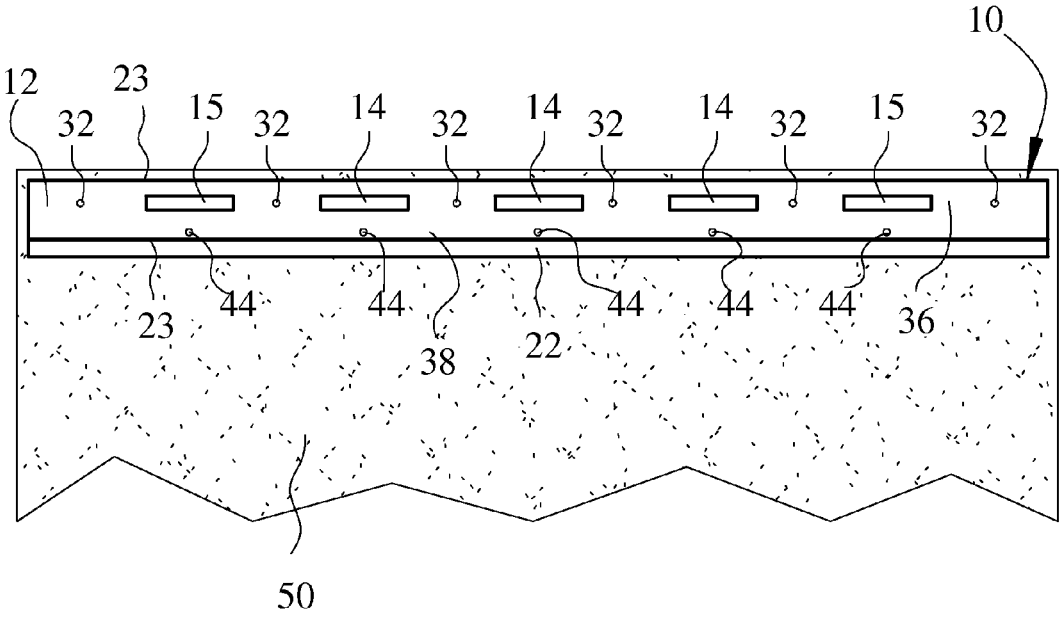
FIG. 2H shows a top view of a panel base plate unit.

Referring to FIG. 2F, the location and method of forming the panel drill locator dimples 44 will be described. The object of the panel drill locator dimple 44 is to allow the do-it-yourself property owner to determine the location of the standard attachment elements 14 and the attachment elements with aperture 15 following the placement of stationary hurricane panels 26 against the attachment faces 24 (FIG. 3A or 3B), obscuring the location of the described attachment elements located behind the described hurricane panels. During the operation phase of the installation the do-it-yourself property owner will be required to determine the location of each standard attachment element 14 and each attachment element with aperture 15 in order to drill through the stationary hurricane panels 26 and also drill into the standard attachment elements 14 and the attachment elements with aperture 15 located behind the described hurricane panels, in order to install the necessary panel attachment fasteners 46 during the panel attaching and securing process. The to be described panel attachment process is often carried out in the short time period, 48 hours or less, prior to the arrival of a hurricane.

Referring to FIGS. 2E and 2F, one panel drill locator dimple 44 will be indented in the panel supporting surface 38 positioned to be centered in front of each of the standard attachment elements 14 and the attachment elements with apertures 15 (FIG. 2E). The location of the panel drill locator dimple 44 will be a minimum of one (1) inch out from the attachment surface 24 approximately ¼" to ½" from the beveled panel "kick up" surface 22 (FIG. 2E) providing space for positioning the stationary hurricane panels 26 and the inside access hurricane panels 28 upon the plate panel supporting surface 38. This described space provides the necessary space for the panel drill locator dimples 44 to remain visible during the installation process. The method for forming the shallow but visible panel drill locator dimples 44 upon the plate panel supporting surface 38 would include using a router with a ball end or round nose router bit or using a powered rotary tool with a core box bit or carbide cutter bit. The method for the forming of a shallow but visible panel drill locator dimple 44 would be readily accomplished by a person with ordinary skill in the art.

Operation

In operation of the first embodiment, as illustrated in FIG. 3A (frontal), 3B (frontal), FIG. 2E (perspective), FIG. 4B (end view), and FIG. 1 (frontal perspective view) the manner of installing and using the do-it-yourself panel base plate unit 10 and building owner selected non-permanent hurricane panels will be described.

Two versions of the first embodiment will be described. The first description of operation will address the steps involved in the installation of hurricane panels over wide expanses of glass found on a ground level structure. The second description of operation of this embodiment will address the steps involved in installing hurricane panels over glass units found in multi-level structures requiring the installer to gain access back into the inside of the structure following the installation of hurricane panels.

Operation of Ground Level Installation

The installation and operation of this first embodiment on a ground level installation of hurricane panels over a glass unit to be protected will consist of the following steps to be carried out by the do-it-yourself property owner:

Step 1—Obtain the necessary number of owner-selected and properly sized hurricane panels 26 to cover the glass unit to be protected 40. The recommended plywood is OSB plywood sheathing. The minimum approved thickness is 7/16", however a recommended thickness of ⅝" or ¾" offers additional protection from air-borne debris. It is recommended that a waterproofing finish be applied to plywood panels prior to installation if the property owner planned to use the hurricane panels 26 more than once. The do-it-yourself property owner will determine the type and necessary number of panels required to cover the glass unit to be protected 40.

Figure 4A:
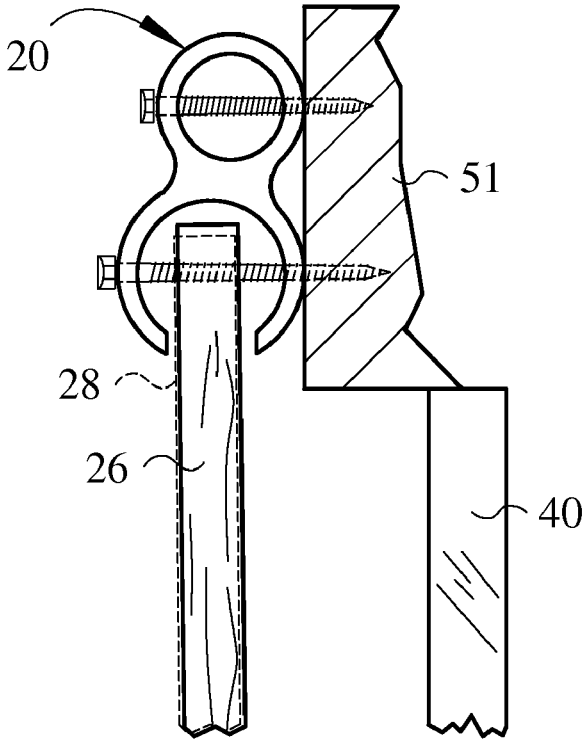
FIG. 4A shows a side view of an upper panel track securing device.

Step 2—To secure the upper edge of the hurricane panels 26, a C shaped or U shaped channeled device or fabrication would be installed above the glass unit to be protected 40. Such upper panel track securing devices 20 are capable of capturing and securing the top edge of a hurricane panel or panels 26 (FIG. 4A). The upper panel track securing device 20 will be installed on the exterior vertical surface 51 (FIG. 4A) in the header area above the door or window to be protected, carefully positioned above the glass unit to be protected 40. One recommended upper panel track securing device 20 would include the commercially available panel retaining and attachment system sold under the trade name Panel Channels®, this system being the cross-referenced patent application number 11966626, filed Dec. 28, 2007, by the present inventor. There are a variety of hurricane panel track devices available at big box and local lumber and hardware stores in various lengths. These prior art devices are available for attaching heavy full size sheets of plywood, however the disadvantages of these prior art devices were addressed in the prior art section of this specification. The utility of the do-it-yourself design of this embodiment will become obvious during the operational steps to follow.

Step 3—Once the hurricane panels 26 are sized and waterproofed and the device to secure the top edge of the panels is securely installed directly above the glass unit to be protected 40, the hurricane panel base plate unit 10 will be installed on the deck or other exterior horizontal surface 50, the panel base plate unit 10 properly aligned with and cooperating with the tracks of the installed upper panel track securing device 20 installed to capture and secure the top edge of a single or plurality of hurricane panels 26 immediately in front of the outside surface of the glass door or window unit to be protected 40.

Figure 6A:
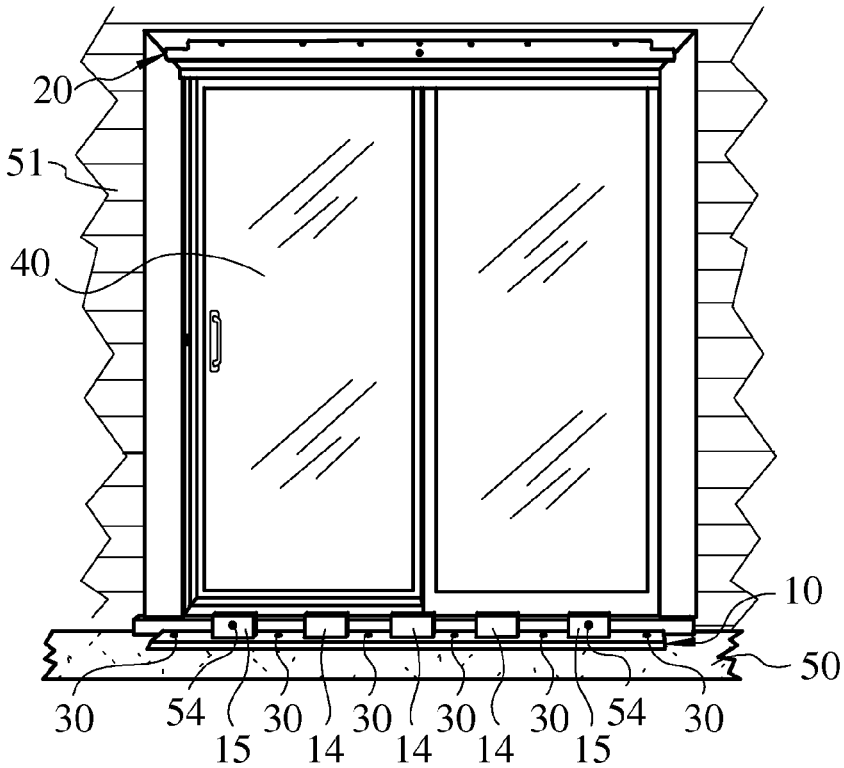
FIG. 6A shows a frontal view of an installed panel base plate unit prior to hurricane panel installation.
Figure 6B:
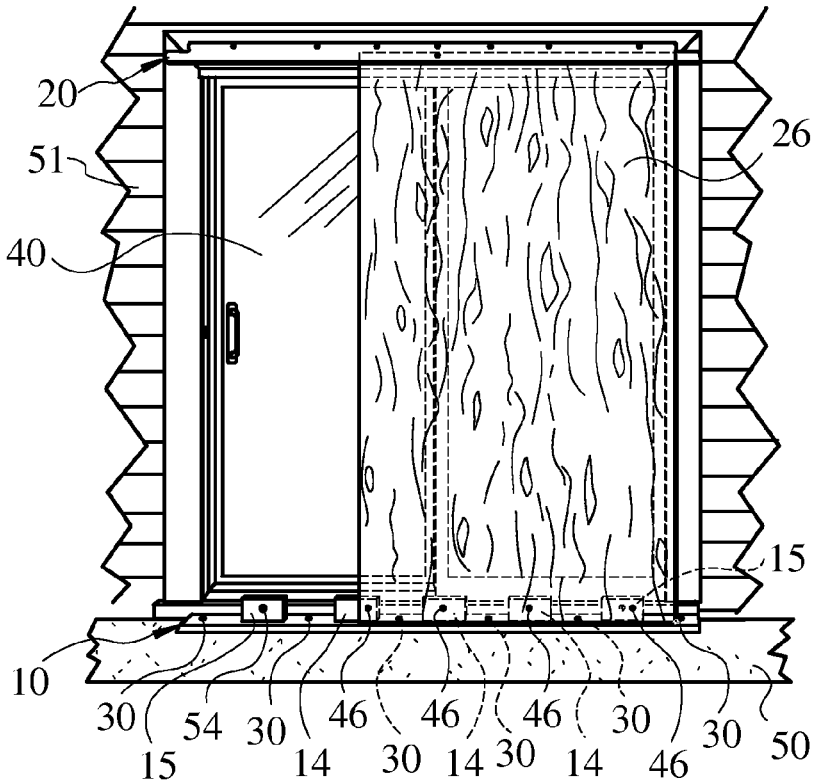
FIG. 6B shows a frontal view of an installed panel base plate unit with a stationary hurricane panel installed.

Step 4—Depending upon the composition of the exterior horizontal surface 50, the proper fasteners for securing the panel base plate unit 10 to the exterior horizontal surface 50 can be selected, as explained below. As shown in FIGS. 3A, 6B, and 4B if the deck or exterior horizontal surface 50 is of wood or plastic composition, a preferred wood base plate attachment fastener 30 would be stainless steel or galvanized 5/16 standard hex headed lag bolts of appropriate length. The panel base plate unit 10 is secured to the exterior horizontal surface 50 with a plurality of appropriate fasteners 30 passing through the base plate unit attachment apertures 32 provided in the base plate bonding and attachment surface 36.

If the deck or exterior horizontal surface 50 is of concrete or masonry composition, an appropriate concrete anchor type base plate attachment fastener 30 would be selected. Among the several concrete anchors available, an industry standard for this type application would include Tapcon® concrete anchors. The recommendation for this installation would be the 1/4"×2 1/4" Tapcon hex head anchor. The drill size for this anchor is 3/16 ", the hex head size is 5/16". The choice of fasteners and the securing of the panel base plate unit 10 to the exterior horizontal surface 50 would be readily accomplished by a do-it-yourself property owner with ordinary skill in the art.

Step 5—The do-it-yourself advantages of this improved support, securing and attachment of full size sheets of plywood and other hurricane panel materials will now become apparent. FIG. 3A illustrates two (2) equally sized hurricane panels 26 installed over a glass unit to be protected 40. The do-it-yourself property owner will now proceed as follows:

(a) Position a hurricane panel 26 directly in front of the panel base plate unit 10 and the portion of the glass unit to be protected 40.

(b) Slide the upper edge of the hurricane panel 26 into the capturing and upper panel track securing device 20 (FIG. 4A) directly above and outside of the glass unit to be protected 40. Once the upper panel edge is captured, then urge or slide the lower edge of the hurricane panel 26 along the exterior horizontal surface 50 toward the glass unit to be protected 40 until the hurricane panel 26 comes in contact with the beveled panel "kick-up" surface 22 of the panel base plate unit 10.

(c) Taking advantage of the beveled panel "kick-up" surface 22, enough force would be applied to the lower portion of the hurricane panel 26 so as to urge the lower edge to skid, slide or be kicked forward, up, and onto the plate panel supporting surface 38 and against the attachment surface 24 of the standard attachment element 14, thus positioning the hurricane panel 26 for proper attachment and securing, while eliminating the need for the do-it-yourself property owner to lift the total weight of the hurricane panel 26 to align and lower the hurricane panel into a prior art type track or channel device. The beveled panel "kick-up" surface 22 design eliminates the need to lift the hurricane panel 26 up and onto the panel supporting surface 38 of the panel base plate unit 10.

Figure 4B:
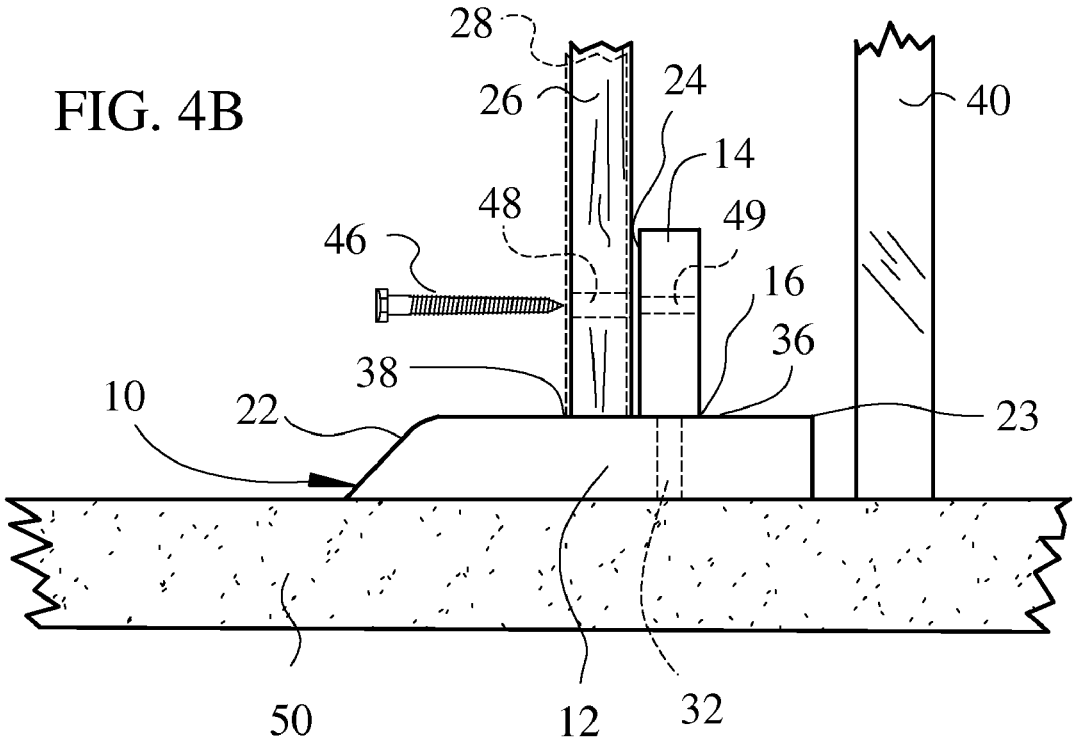
FIG. 4B shows a side view of a panel base plate unit mounted on an exterior horizontal surface in front of a glass unit to be protected with stationary and inside access hurricane panels depicted.

(d) As shown in FIG. 4B, the do-it-yourself installer would now drill a panel fastener aperture 48 in the hurricane panel 26, immediately in front of and in the center of a attachment element 14 as located for the installer by the panel drill locator dimple 44 located on the plate panel supporting surface 38 of the panel base plate unit 10 immediately in front of the center of each attachment element 14. Following the determination of the location to drill the panel fastener aperture 48, the installer would drill the panel fastener aperture 48 through the hurricane panel 26 while avoiding drilling into the attachment element 14. A preferred panel attachment fastener 46 would be 5/16" or 3/8" stainless steel or galvanized hex head lag bolts, 1 1/2" to 2" long, dependent upon the thickness of the hurricane panel 26. A preferred panel fastener aperture 48 for 5/16" or 3/8" panel attachment fasteners 46 would be a drill size of 3/8". The installer would now drill a smaller panel fastener pilot aperture 49 in the attachment elements 14 to properly accept and retain the base plate attachment fasteners 30. A preferred panel fastener pilot aperture 49 of 1/4" would accommodate a 5/16" or 3/8" panel attachment fastener 46. The attaching and pilot apertures for attaching the hurricane panel 26 to the attachment element 14 sequence would be readily understood by a do-it-yourself craftsman with ordinary skill in the art. This described process would continue until all hurricane panels 26 were properly attached to each of the standard attachment elements 14 of the panel base plate unit 10.

Figure 5A:
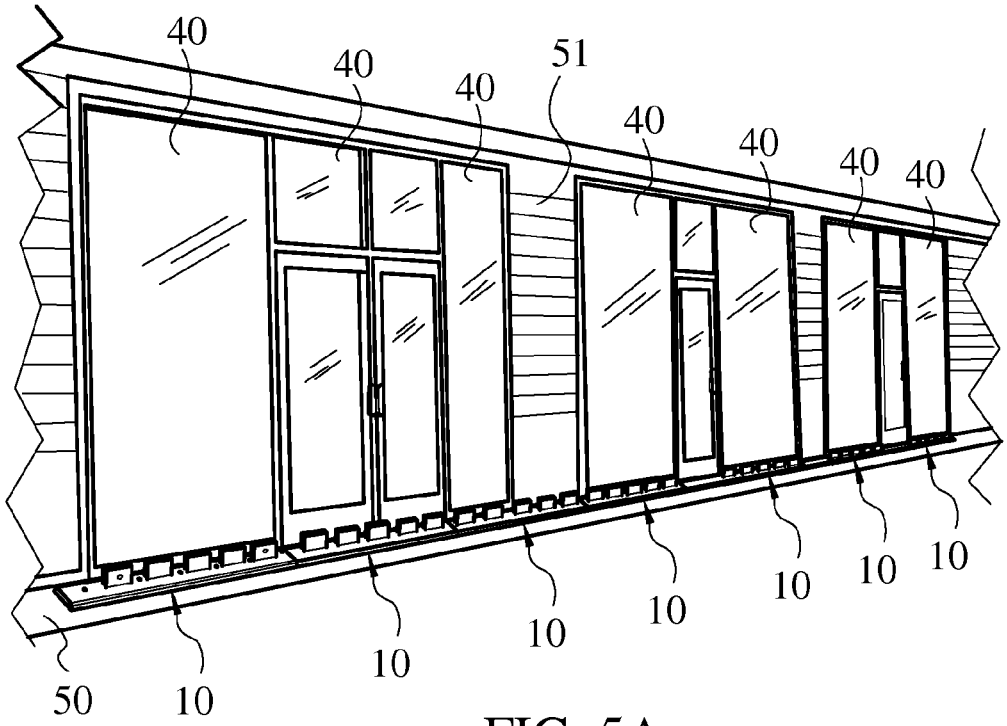
FIG. 5A shows a perspective view of an end-to-end side-by-side installation of multiple panel base plate units installed.
Figure 5B:
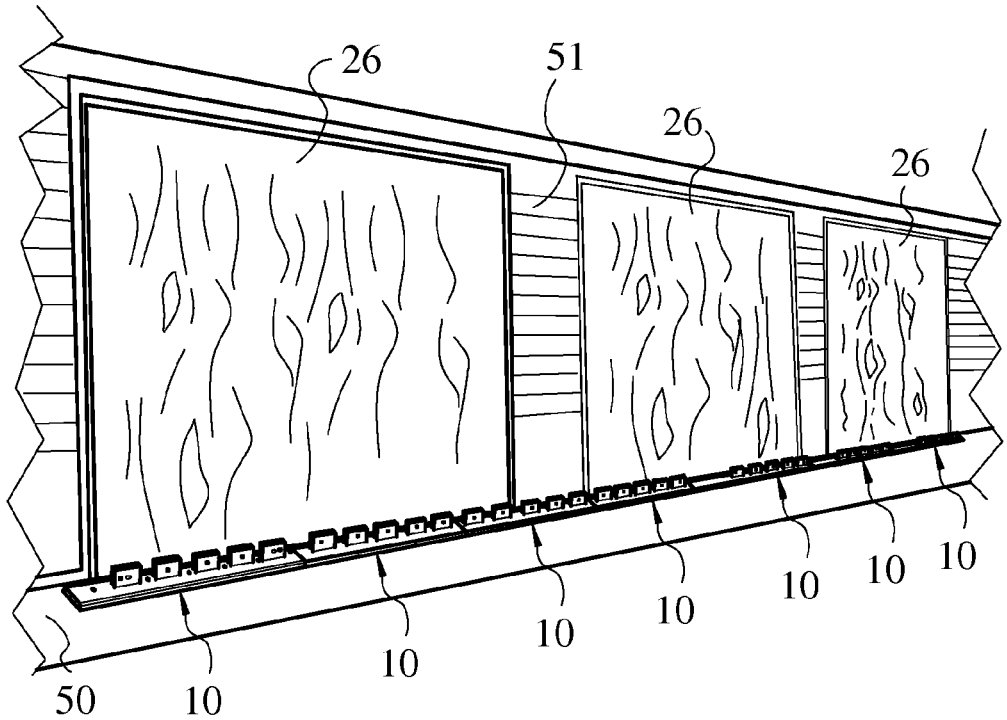
FIG. 5B shows a perspective view of an end-to-end side-by-side installation of multiple panel base plate units with stationary hurricane panels installed.

FIGS. 5A and 5B illustrate an end-to-end and side-by-side installation of panel base plate units 10 and non-permanent hurricane panels installed over and along a commercial row of glass doors and windows for protection from the flying debris associated with hurricane force winds. The substantially matching cross-sectional shape of the panel base plate units 10 of this embodiment allows for unlimited end-to-end and side-by-side installations of panel base plate units 10 of assorted lengths.

Operation of Upper Level, Multi-Level Structure Installation

The following is a modified do-it-yourself installation and operation of this first embodiment specifically described for high-rise or multi-level structure installation. The most common apparatus for entering and exiting the outside balcony area of coastal located multi-level apartments and condominiums are sliding glass patio doors. Prior art has shown little interest in providing a do-it-yourself system for rapid owner installation of non-permanent hurricane panels to protect upper level sliding glass patio doors. The specific problem lacking a solution is a method for the installer to re-enter the interior of the structure from the upper-level balcony following a do-it-yourself owner installation of plywood or plastic hurricane panels from the outside location. A multi-level do-it-yourself installation of hurricane panels over a glass unit to be protected will be described. This installation will include the solution for the do-it-yourself property owner to re-enter and remain within the structure during the final phase of the following hurricane panel installation steps:

Step 1—As illustrated in FIGS. 3A and 3B, the principal difference in the multi-level operation is the installation of one (1) inside access hurricane panel 28 (FIG. 3B) in addition to the necessary number of stationary hurricane panels 26 required to cover and protect the glass unit to be protected 40. The recommended width of the inside access hurricane panel 28 would be twenty four (24) inches, with the height being determined by the height of the glass unit to be protected 40. The installer would obtain one (1) inside access hurricane panel 28 of twenty four (24) inch width and obtain the necessary panel materials 26 to complete the protection of the glass unit to be protected 40. With this described modification to Step 1, the do-it-yourself installer would follow the same operations as Step 1, Step 2, Step 3, and Step 4 as outlined in the "OPERATION OF GROUND LEVEL INSTALLATION" described earlier. Once Steps 1, 2, 3, and 4 are completed, the required method for installing panels in a multi-level installation will now continue beginning with the following Step 5.

Step 5—FIG. 1 illustrates a stationary hurricane panel 26 installed from outside the structure and the inside access hurricane panel 28 prior to final installation. The final installation of the inside access hurricane panel 28 will be accomplished from inside the structure and from inside the sliding patio door glass unit to be protected 40. At this point in the installation the hurricane panels 26 and 28 have not been installed. This do-it-yourself property owner installation will now proceed as follows:

(a) Position a hurricane panel 26 directly in front of the panel base plate unit 10 and the portion of the glass unit to be protected 40.

(b) Slide the upper edge of the hurricane panel 26 into the capturing and upper panel track securing device 20 (FIG. 4A) directly above and opposite the glass unit to be protected 40. Once the upper panel edge is engaged, then urge or slide the lower edge of the hurricane panel 26 along the exterior horizontal surface 50 toward the glass unit to be protected 40 until the hurricane panel 26 comes in contact with the beveled panel "kick-up" surface 22 of the panel base plate unit 10.

The "c" and "d" installation steps and instructions included in Step 5 of the "OPERATION OF GROUND LEVEL INSTALLATION" described earlier would be followed at this time. As illustrated in FIG. 6B, the installation of the stationary hurricane panels 26 is complete, allowing the necessary unprotected space of twenty four (24) inches. Step 6 will begin the description of the inside access installation of the inside access hurricane panel 28.

Figure 7A:
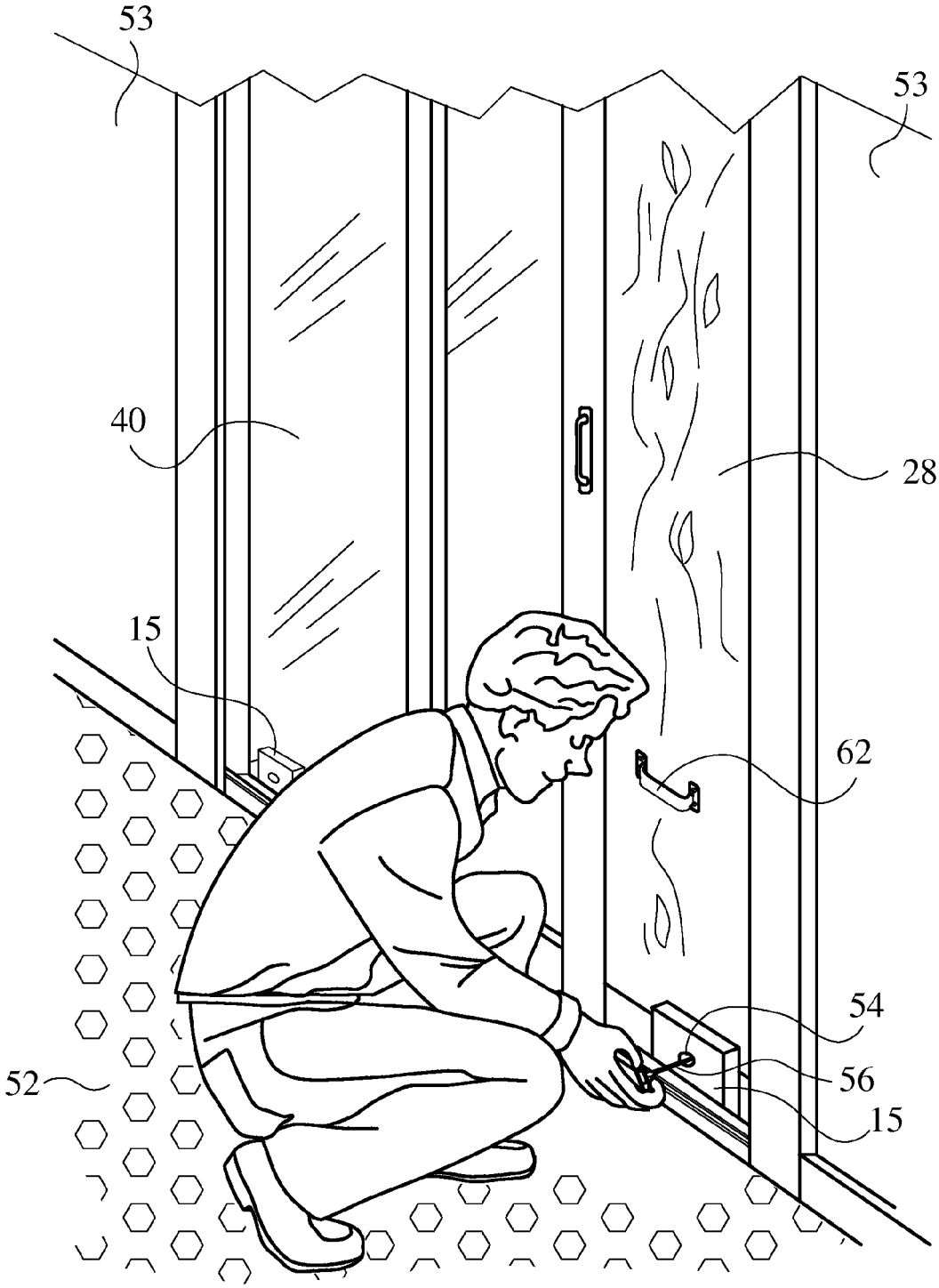
FIG. 7A shows a view from inside the structure of the installation of the access panel securing fastener into the access panel cooperating receiving fastener.

Step 6—Preparation for the installation of the inside access hurricane panel 28 by the do-it-yourself property owner will proceed as follows:

(a) Attach the interior handle 62 to one side of the inside access hurricane panel 28 in the approximate position illustrated in FIG. 7A. (This "a" operation will be required only the first time the installation of the inside assess hurricane panel 26 is performed. In future installations the interior handle 62 will have been previously installed.)

(b) Following the attachment of the interior handle 62, slide open the door of the glass unit to be protected 40. From inside the structure, insert the upper edge of the inside access hurricane panel 28 into the capturing and engaging upper panel track securing device 20 (FIG. 4A) directly above and outside of the glass unit to be protected 40 using the interior handle 62 to assist in the placement. Next pull the attached interior handle 62 in such a way as to bring the hurricane panel 28 past the beveled panel "kick-up" surface 22 up and onto the panel supporting surface 38 and snugly into contact with the attachment surface 24 of the attachment element with aperture 15, FIG. 7B.

Figure 7B:
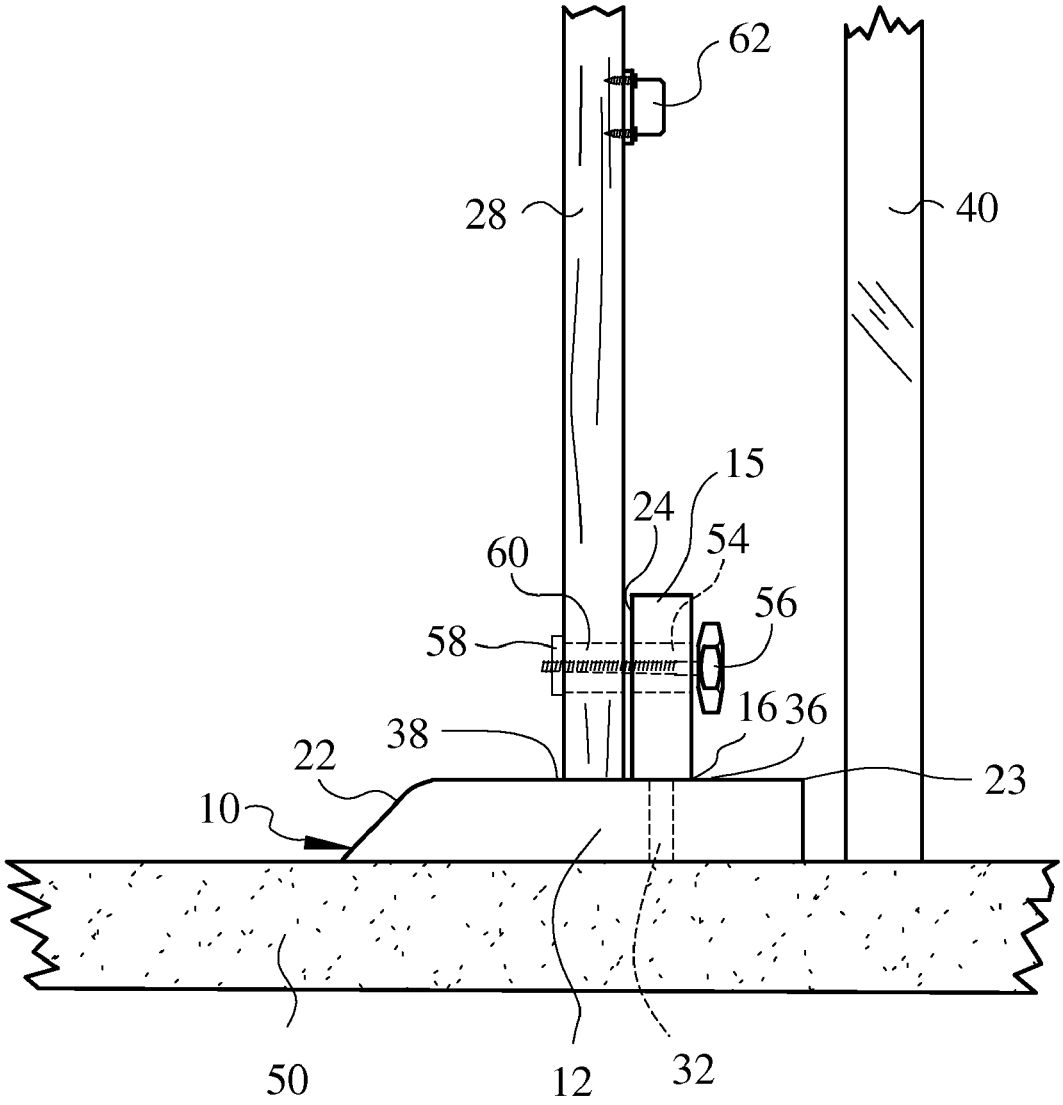
FIG. 7B shows a side view of a panel base plate unit mounted on an exterior horizontal surface including an access panel cooperating receiving fastener, an access panel receiving fastener aperture, an interior handle, and an access panel securing fastener.

(c) With the inside access hurricane panel 28 resting on the panel supporting surface 38, the installer will stabilize the panel 28 using the interior handle 62 and drill a ½" hole 60 through the inside access hurricane panel 28, using the attachment element access aperture 54 as a template for drilling the access panel receiving fastener aperture 60 (FIG. 7B). (These "c." and "d" operations will be required only the first time the installation of the inside access hurricane panel 28 is performed. In future installations, the access panel receiving fastener aperture 60 will have been previously drilled and the access panel cooperating receiving fastener 58 will have been installed.)

(d) The drilling of the access panel receiving fastener aperture 60 provides the aperture necessary to install the access panel cooperating receiving fastener 58. A broad variety of female threaded wood insert fasteners are available, including Wood-Serts®, Tap-Lok®, E-Z Lok, and Yardley® Trisert® among others. These inserts are easy to install, won't pull out, and allow the do-it-yourself installer to securely install a ⅜"×16 access panel cooperating receiving fastener 58 into the ½" access panel receiving fastener aperture 60 for providing the installer a ⅜"×16 female threaded receiving fastener 58 to receive and secure the access panel securing fastener 56. In addition to wood insert fasteners, another recommend fastener would be the Toggler® brand snaptoggle bolt anchor, an easy solution for providing the necessary ⅜"×16 cooperating and receiving fastener 58 designed for installation in the ½" access panel receiving fastener aperture 60 (FIG. 7B) as the receiving fastener 58 for the access panel securing fastener 56.

(e) The selected access panel cooperating receiving fastener 58 will now be installed through and into the access panel receiving fastener aperture 60 so as to receive and co-operate with the inside installation of the access panel securing fastener 56.

(f) Following the installation of the access panel receiving fastener 58, the installation will proceed from inside the structure with the installer grasping the interior handle 62 and inserting the upper edge of the inside access hurricane panel 28 into the capturing and engaging upper panel track securing device 20 (FIG. 4A) directly above the glass unit to be protected 40, using the interior handle 62 to assist in the placement. Next the interior handle 62 will be urged in such a way as to bring the hurricane panel past the beveled panel "kick-up" surface 22 and snugly into contact with the attachment surface 24 of the attachment element with aperture 15 (FIG. 7A).

(g) The final step in securing the inside access hurricane panel 28, from a position inside the structure will involve the access panel securing fastener 56. The selection of the fastener 56 will be made from a variety of acceptable and readily available fasteners including/3;8"×16×2½ " shouldered thumb screw or a threaded knob thumb screw available from a variety of suppliers including, among others, Shear-Loc®, J. W. Winco®, or Knobs Direct. As illustrated in FIGS. 7A and 7B, with the selected access panel securing fastener 56 passing through the attachment element access aperture 54, the installer will now engage the threads of the access panel securing fastener 56 with the cooperating threads of the access panel cooperating receiving fastener 58. The installer will continue to tighten the access panel securing fastener 56 until the inside access hurricane panel 28 is solidly secured against the attachment surface 24 of the attachment element with aperture 15 and the panel base plate unit 10. The installation is now complete, with the do-it-yourself installer located inside the structure and the glass unit to be protected 40.

Alternative Embodiments

Because building attachment surfaces are disposed horizontal, vertical, and slanted, various embodiments are necessary to attach and secure the lower portion of hurricane panels to the surfaces of common building structures with glass door or window openings to be protected. The following additional embodiments disclose the more obvious applications to which the basic principles of the invention are applied in related ways.

Figure 8A:
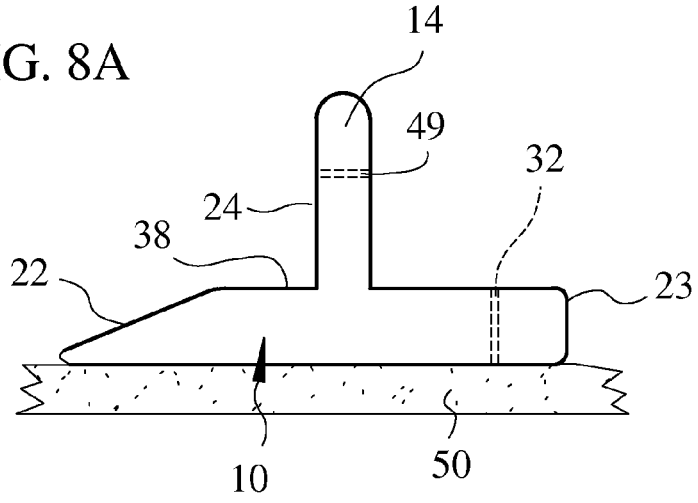
FIG. 8A shows a side view of an extruded panel base plate unit.
Figure 8B:
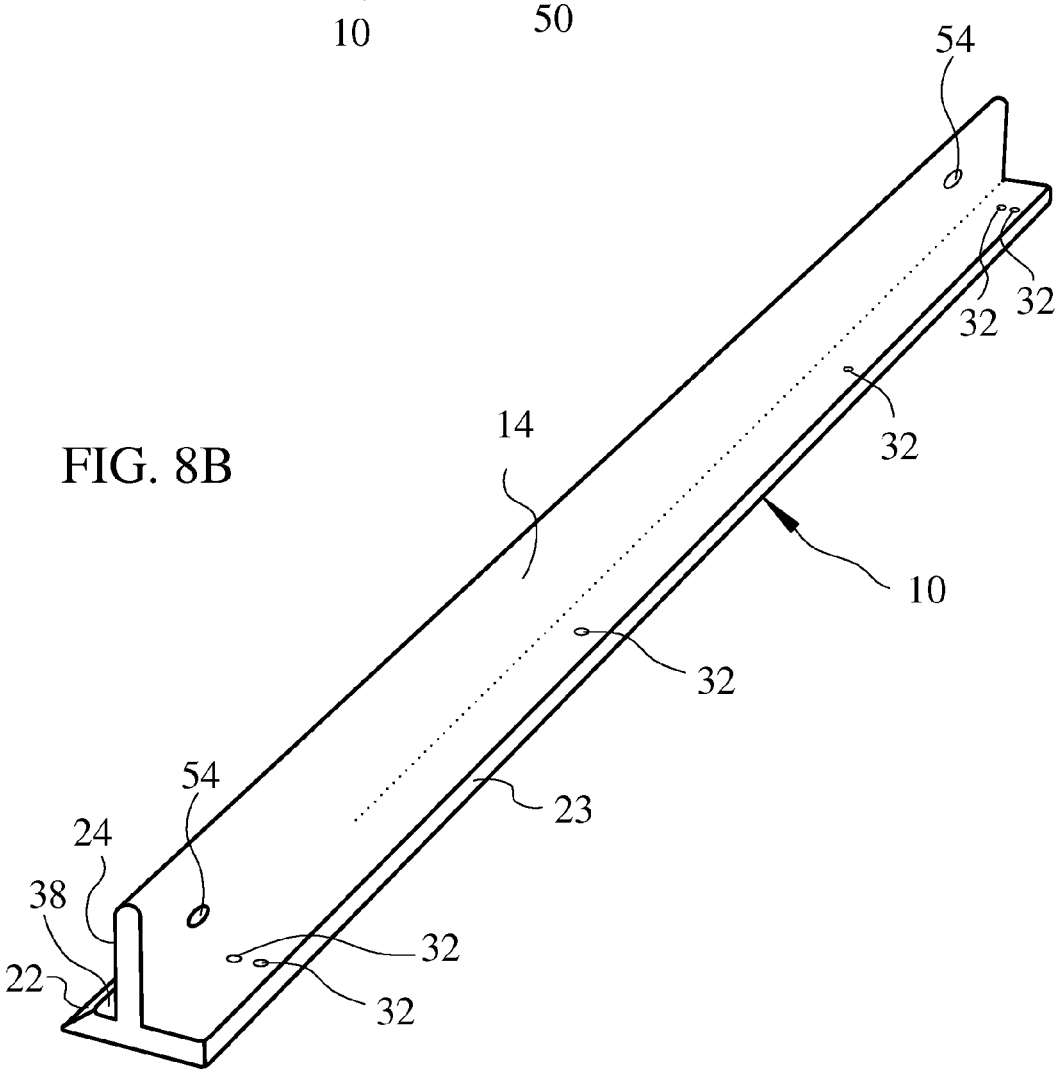
FIG. 8B shows a perspective view of an extruded panel base plate unit.

FIGS. 8A and 8B

Alternative Embodiment

There are various possibilities and methods of extruding PVC and cellular PVC. Currently over seven (7) manufacturers offer trim board, moulding, and deck products of cellular PVC. These manufacturers also offer custom services for extruding custom shapes. FIGS. 8A and 8B show a panel base plate unit 10 extruded as a single configuration of plastic composition.

Figure 9A:
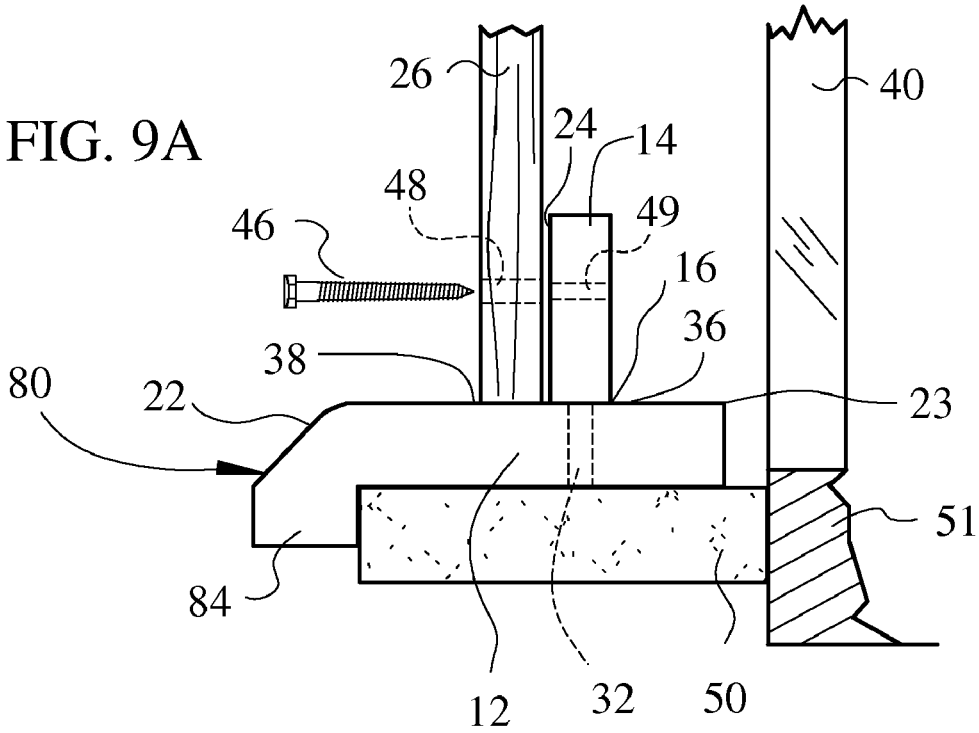
FIG. 9A shows a side view of a window sill base plate unit mounted on a flat window sill.
Figure 9B:
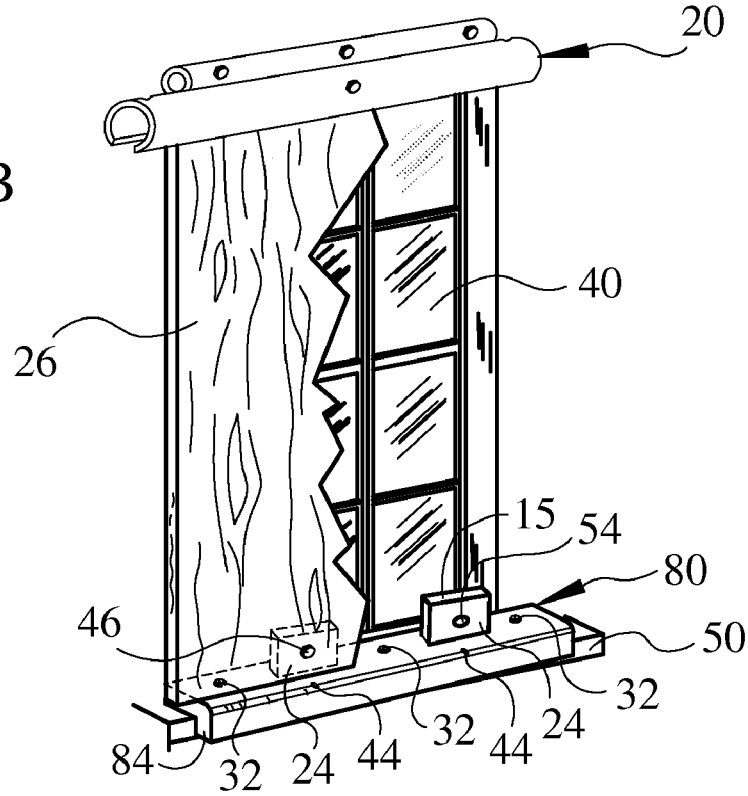
FIG. 9B shows a frontal perspective view of an installed hurricane panel and window sill base plate unit mounted on a flat window sill.

FIGS. 9A and 9B

Alternative Embodiment

FIG. 9A illustrates a side view of a flat window sill base plate unit 80 as an additional embodiment of the base plate unit 10. The illustrated embodiment includes a sill plate lip 84 configuration at the lower front edge of the sill base plate unit 80. FIG. 9B shows a perspective view of the sill base plate unit 80 mounted on a flat window sill surface 50.

Figure 9C:
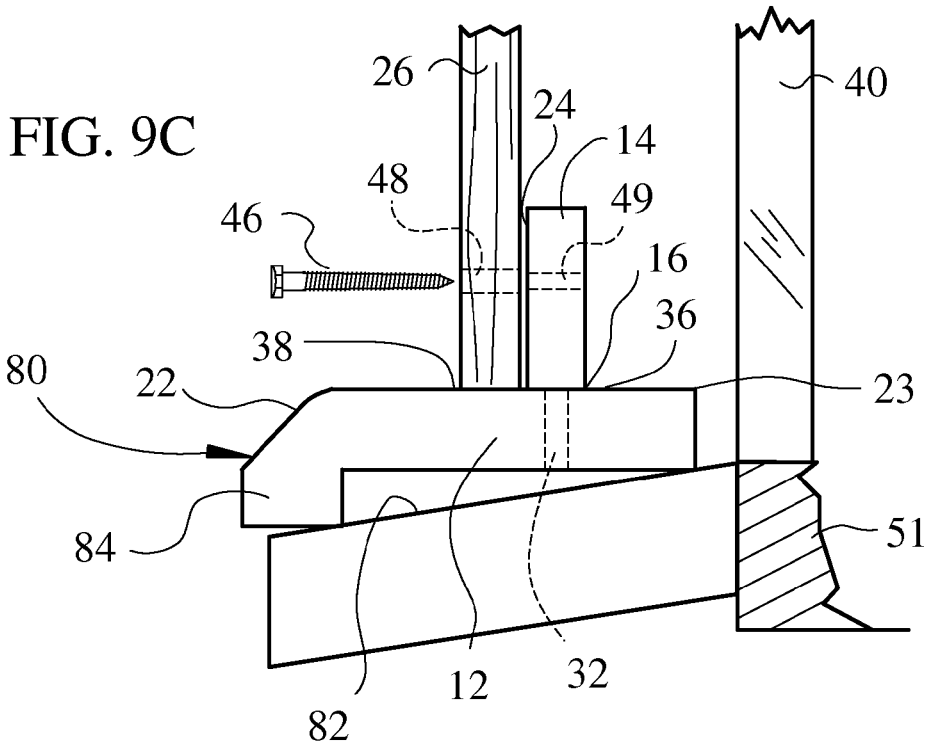
FIG. 9C shows a side view of a window sill base plate unit mounted on a slightly slanted window sill.
Figure 9D:
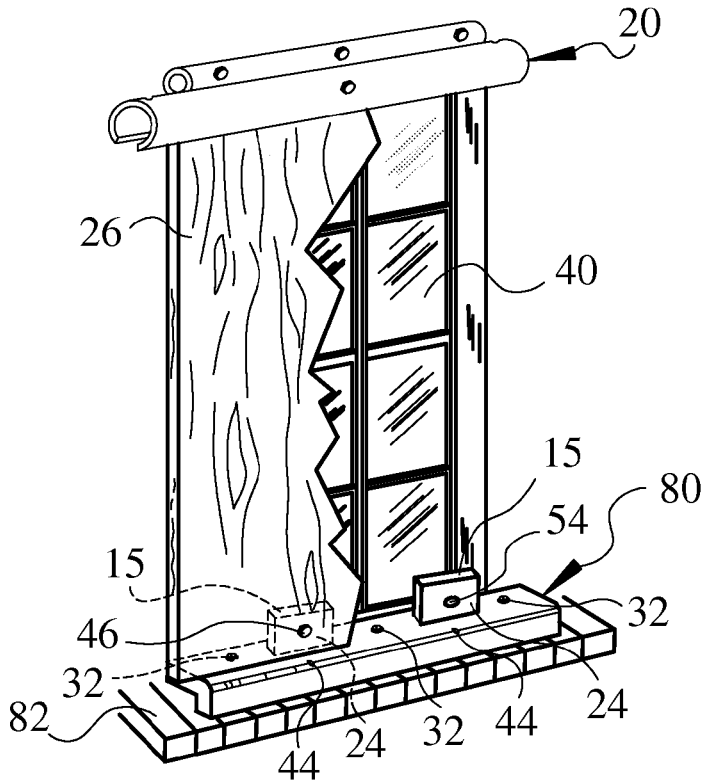
FIG. 9D shows a frontal perspective view of an installed hurricane panel and window sill base plate unit mounted on a slightly slanted window sill.

FIGS. 9C and 9D

Alternative Embodiment

FIG. 9C shows a side view of a window sill base plate unit 80 mounted on a slightly slanted window sill surface 82. The illustrated embodiment includes a sill plate lip 84 configuration at the lower front edge of the sill base plate unit 80. As illustrated in FIG. 9C, the sill plate lip 84 provides an element to raise the forward edge of the panel supporting surface 38 to a more horizontal position. FIG. 9D shows a perspective view of the sill plate unit 80 mounted on a slightly slanted window sill surface 82.

Figure 10A:
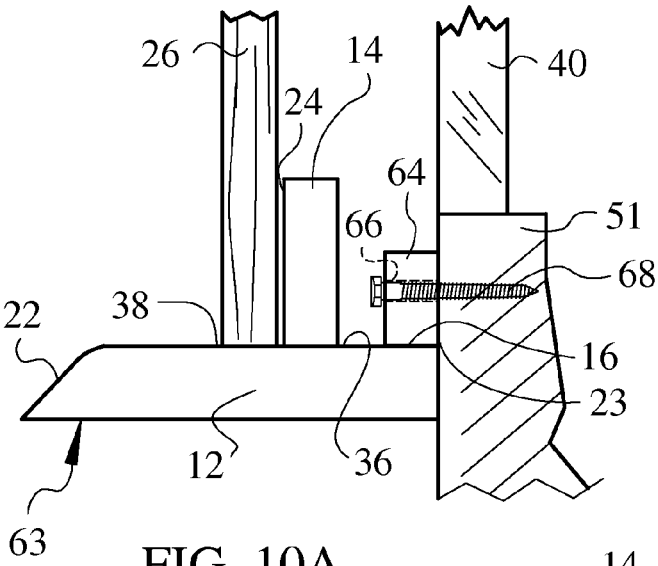
FIG. 10A shows a side view of vertical mounted panel unit on an exterior vertical surface in front of a glass unit to be protected with a hurricane panel depicted.
Figure 10B:
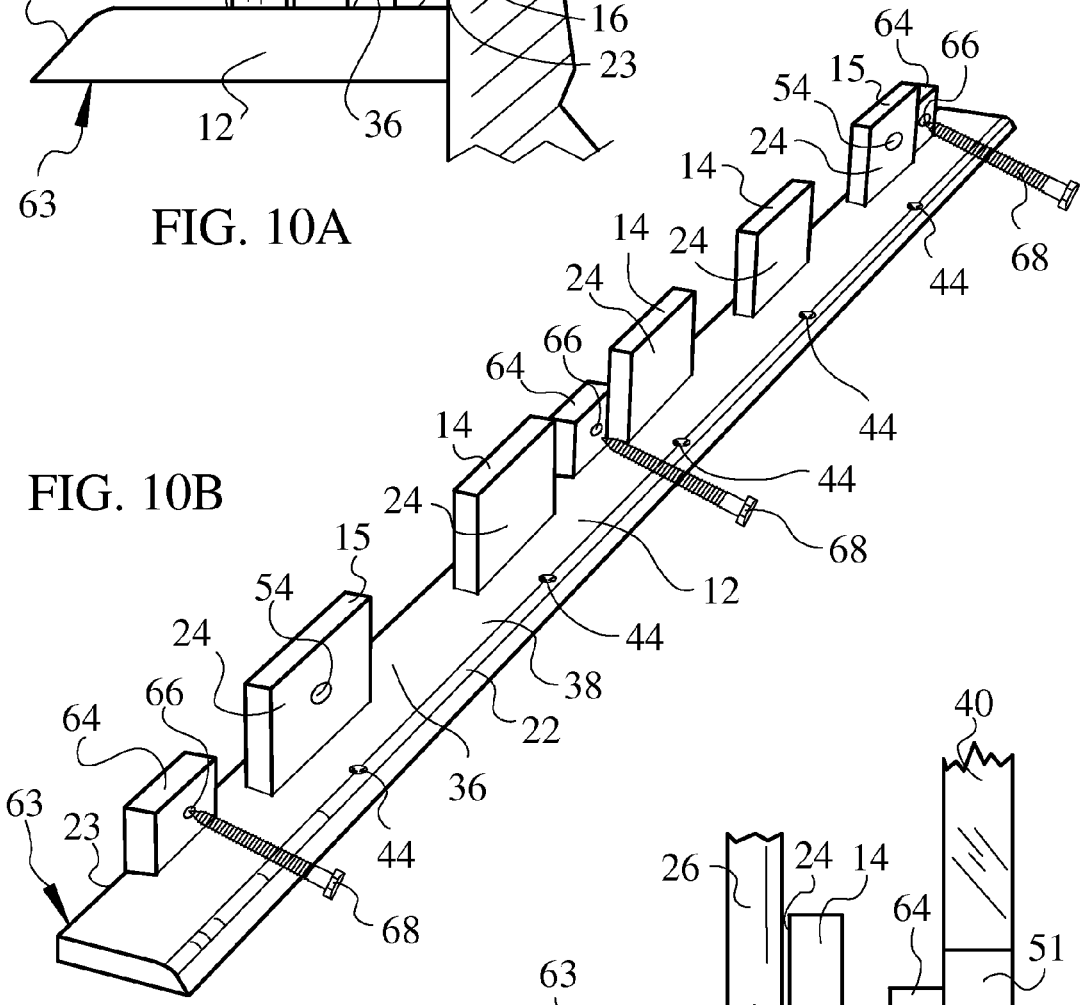
FIG. 10B shows a perspective view of a vertical mounted panel unit.
Figure 10C:
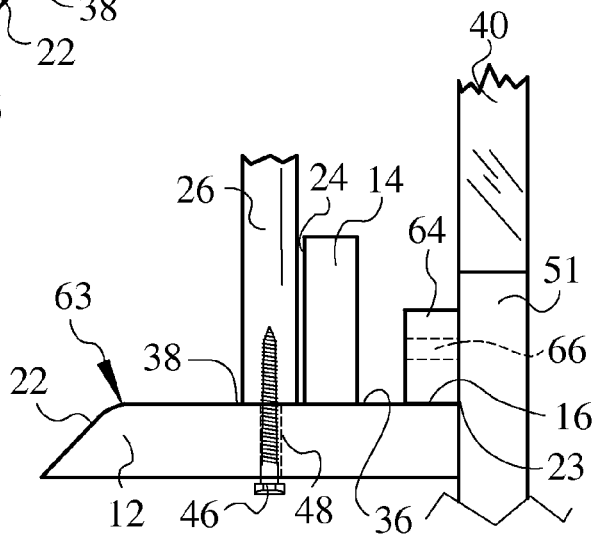
FIG. 10C shows a side view of vertical mounted panel unit on an exterior vertical surface in front of a glass unit to be protected with a hurricane panel attached through the base plate supporting element.

FIGS. 10A, 10B, and 10C

Alternative Embodiment

FIG. 10A shows a side view of a hurricane panel support and attachment device adapted as a vertical mounting panel unit 63 to be mounted against and attached to a exterior vertical surface 51. Vertical mounting elements 64 are provided and bonded to the base plate bonding and attachment surface 36. The vertical mounting elements 64 are drilled to provide vertical mounting apertures 66 to accept vertical mounting fasteners 68 as illustrated in FIG. 10B.

A further alternative in this embodiment is illustrated in FIG. 10C, showing a variation of attaching the hurricane panel 26 to the panel supporting surface 38. As illustrated in FIG. 10C, the panel attaching fastener 46 passes through the panel fastener aperture 48 drilled through the base plate supporting element 12 as illustrated.

FIGS. 11A, 11B and 11C

FIG. 11C shows a perspective view of an extruded vertical mounted panel unit 63, extruded as a single configuration of plastic composition.

FIG. 11A shows the extruded vertical mounting panel unit 63 attached to a exterior vertical surface 51 and the hurricane panel 26 attached to an attachment surface 24 with panel attachment fasteners 46 passing through the frontal surface of the hurricane panel 26 and secured into the extruded vertical mounted panel unit 63 and supported by the panel supporting surface 38.

FIG. 11B illustrates a variation of the extruded vertical mounted panel unit 63 showing the hurricane panel secured upon the panel supporting surface 38 by panel attachment fasteners 46 passing up through the extruded panel unit 63 panel supporting surface 38 into the bottom edge surface of the hurricane panel 26, to attach and secure the hurricane panel 26.

CONCLUSION, RAMIFICATIONS, AND SCOPE

Accordingly, the reader will see that at least one embodiment of the do-it-yourself glass door or window storm panel supporting and attachment system provides property owners with average do-it-yourself skills, a more affordable and simplified system for protection of glass doors and windows immediately prior to the arrival of a hurricane. Following a hurricane watch or warning, supplies of plywood, plastic panels, and other suitable materials can be obtained by property owners. Currently the majority of property owners are forced to nail or bolt the panel materials to the structures to protect glass doors and windows. Owners of multi-lever properties are unable to protect balcony glass doors due to the need to re-enter the living space following the installation of panel materials. Embodiments of the described system allow property owners access back into the interior area of the property after the installation of hurricane panels. Furthermore, the do-it-yourself glass door and window hurricane panel lower edge attachment system has the additional advantages that:

- It permits today's expanding do-it-yourself market with a much needed solution to protecting large expanses of glass doors and windows.
- It permits home owners to install affordable and available lumber yard panel materials.
- It does not require the property owner to allow weeks or months for an expensive custom protection system to be designed, fabricated and installed.
- It allows protection of extended commercial expanses of shopping center and storefront glass doors and windows after a hurricane watch or warning is issued.
- It eliminated the need for a do-it-yourself property owner to lift the entire weight of full size sheets of plywood and place them in track or channels when protecting sliding glass patio doors or French type doors.
- It eliminates the requirement of most glass door protection systems to mount the lower panel securing device to the vertical building surface rather than the readily available horizontal deck or concrete outside surface provided in home and commercial structures.

Accordingly the reader will see that the panel attachment unit requires minimum manufacturing facilities. The recommended material for the invention is cellular PVC (polyvinyl chloride), PVC, or other polymer materials offering improved strength-to-weight ratios over other materials thereby increasing safety and convenience. PVC material is readily available, relatively low cost, a non-conductor of electricity, corrosion resistant, chemical resistant, and immune to electrochemical reactions caused by acids, bases, and salts that cause corrosion in metals. In addition, PVC production is an energy efficient manufacturing process, with more than half of the raw material used in PVC production provided by salt, of which there is virtually an unlimited supply.

While my above description contains many specificities, these should not be construed as limitations on the scope, but rather as an exemplification of one of several preferred embodiments thereof. Many other variations are possible.

What is claimed is:

1. A non-permanent hurricane panel support and attachment device adapted for removable attachment to an exterior substantially horizontal building surface located below and in front of a vertical glass door or window surface of an exterior vertical building structure for vertically supporting and securing the lower edge of one or more planer hurricane panels, the top edge of said planer hurricane panels captured and engaged by an owner-provided and installed top of panel capturing and securing device cooperating with said panel support and attachment device, said panel support and attachment device comprising:

(a) a rigid base plate supporting element of a predetermined cross-sectional shape and thickness and a longitudinal length equal to or greater than the width of said vertical glass door or window surface, (b) said base plate supporting element having a top surface, adapted to provide a load-bearing panel support surface aligned along and parallel to a front edge of said base plate supporting element, an adjacent attachment area, and an adjacent rear area parallel to a back edge, a bottom surface adapted to rest upon said horizontal building surface, two end surfaces, a back surface adapted to face said vertical glass door or window surface and a beveled surface sloping downwardly across and parallel to said front edge at a predetermined angle with respect to said top surface, (c) said load-bearing panel support surface sized to accept and support a plurality of planer panel materials selected from the group consisting of CDX plywood sheathing, corrugated plastic panels, honeycombed plastic panels, and OSB board panels, said planer panel materials having a front panel surface, a back panel surface, a bottom panel surface and a top panel surface, (d) said beveled surface acts as a means for slidably moving said planer hurricane panels from said horizontal building surface, up and onto said load-bearing panel support surface, (e) a plurality of vertical attachment elements, fixedly attached along said attachment area of said top surface so as to form one said panel support and attachment device, said panel support and attachment device having a substantially inverted T-shaped cross section, (f) each of said plurality of vertical attachment elements having a generally flat front securing and alignment surface aligned parallel to said front edge, a back, a top, a bottom and two sides, and of sufficient size to be adapted for engagement with and non-permanent securing of said planer hurricane panels aligned along a plane defined by said flat front securing and alignment surfaces, (g) said top surface having a plurality of apertures adapted to receive first mechanical fasteners, said plurality of apertures arranged so as to be parallel to and located a predetermined distance from said back edge and between said back edge and the plane defined by said flat front securing and alignment surfaces, (h) said panel support and attachment device removably securable to said horizontal building surface by means of said first mechanical fasteners, (i) said planer hurricane panels removably securable to said vertical attachment elements by means of second mechanical fasteners from a location outside said vertical glass door or window surface, (j) means for removably securing one of said planer hurricane panels to at least one of said vertical attachment elements from a location inside said vertical glass door or window surface, (k) said panel support and attachment device having a predetermined and substantially matching cross-sectional shape to afford an abutting, end-to-end and side-by-side contiguous configuration sequence of a plurality of said panel support and attachment devices.

2. The panel support and attachment device set forth in claim 1, wherein:

said panel support and attachment device being fabricated of rigid, non-corrosive, non-rusting, non-oxidizing, cellular PVC board or other plastic or polymer materials.

3. The panel support and attachment device set forth in claim 1, wherein:

said panel support and attachment device is formed as a single extruded plastic profile unit incorporating the base plate supporting element and the vertical attachment element of the device.

4. The panel support and attachment device set forth in claim 1, wherein:

said panel support and attachment device is extruded as a single metallic component incorporating the base plate supporting element and the vertical attachment element of the device.

5. The panel support and attachment device set forth in claim 1, wherein:

said load-bearing panel support surface being adapted to accept a plurality of panel materials selected from the group consisting of CDX plywood sheathing, corrugated plastic or metal panels, honeycombed plastic or metal panels, structured polycarbonate panels, accordion plastic or metal panels, and finished lumber panels.

6. The panel support and attachment device set forth in claim 1, wherein:

said first mechanical fasteners for removably securing said panel support and attachment device to said horizontal building surface, said first mechanical fasteners selected from the group consisting of concrete anchors, lag bolts, hanger bolts, j bolts or other suitable fasteners.

7. The panel support and attachment device set forth in claim 1, wherein:

said second mechanical fasteners for removably securing said planer hurricane panels to said vertical attachment elements, said second mechanical fasteners selected from the group consisting of lag bolts, screws, bolts, hanger bolts, self-drilling screws or other suitable fasteners.

8. The panel support and attachment device set forth in claim 1, wherein:

said planer hurricane panels removably secured to said base plate supporting element by means of said first mechanical fasteners from a location outside said vertical glass door or window surface.

9. The panel support and attachment device set forth in claim 1, wherein:

said panel support and attachment device removably secured to an exterior vertical building surface by means of said first mechanical fasteners.

10. The panel support and attachment device set forth in claim 1, wherein:

said horizontal building surface being a window sill extending outwardly and sloping downwardly at a predetermined angle below an exterior vertical window surface.

11. The panel support and attachment device set forth in claim 1, wherein:

said means for removably securing one of said planer hurricane panels to at least one of said vertical attachment elements from a location inside said vertical glass door or window surface, said means further including an externally threaded fastener, an internally threaded panel fastener, a clearance aperture in at least one of said vertical attachment elements and a cooperating mounting hole in said planer hurricane panel adapted to receive and secure said internally threaded panel fastener, said internally threaded panel fastener adapted to receive and cooperate with said externally threaded fastener, said externally threaded fastener extending through said clearance aperture and connecting with and cooperating with said internally threaded panel fastener in a pivotably operable manner as a means to secure said planer hurricane panel to said vertical attachment element from said location inside said vertical glass door or window surface.

* * * * *